US009592940B2

(12) United States Patent
Nyambi et al.

(10) Patent No.: US 9,592,940 B2
(45) **Date of Patent: *Mar. 14, 2017**

(54) INGREDIENT RELEASE SPOUT

(75) Inventors: Samuel Ombaku Nyambi, Marietta, GA (US); Fritz Seelhofer, Lindau (CH)

(73) Assignee: The Coca-Cola Company, Atlanta, GA (US)

( * ) Notice: Subject to any disclaimer, the term of this patent is extended or adjusted under 35 U.S.C. 154(b) by 1397 days.

This patent is subject to a terminal disclaimer.

(21) Appl. No.: 13/039,457

(22) Filed: Mar. 3, 2011

(65) Prior Publication Data

US 2011/0163119 A1 Jul. 7, 2011

Related U.S. Application Data

(63) Continuation-in-part of application No. 12/016,406, filed on Jan. 18, 2008, now Pat. No. 8,443,969, and a continuation-in-part of application No. 11/686,985, filed on Mar. 16, 2007, now Pat. No. 8,276,748.

(51) Int. Cl.

| | |
|---|---|
| ***B65D 25/08*** | (2006.01) |
| ***B65D 51/28*** | (2006.01) |
| ***B65D 47/24*** | (2006.01) |

(52) U.S. Cl.

CPC ..... *B65D 51/2835* (2013.01); *B65D 47/243* (2013.01)

(58) Field of Classification Search

CPC ..... B65D 81/3266; B65D 81/3211; B65D 51/2835; B65D 47/243

USPC ..... 206/219, 220, 222, 217; 215/6, 42, 215/DIG. 8

See application file for complete search history.

(56) References Cited

U.S. PATENT DOCUMENTS

| | | | | |
|---|---|---|---|---|
| 5,927,549 | A * | 7/1999 | Wood | 222/83 |
| 6,170,654 | B1 * | 1/2001 | Gartner et al. | 206/219 |
| 6,679,375 | B1 * | 1/2004 | Coory | B65D 51/2835 206/219 |
| 2003/0089627 | A1 * | 5/2003 | Chelles et al. | 206/219 |
| 2006/0006077 | A1 * | 1/2006 | Mosher | B65D 51/2835 206/219 |
| 2006/0118435 | A1 * | 6/2006 | Cronin et al. | 206/219 |
| 2007/0280042 | A1 * | 12/2007 | Yamanaka | 366/185 |
| 2012/0183657 | A1 | 7/2012 | Marina et al. | |

* cited by examiner

*Primary Examiner* — Jacob K Ackun
*Assistant Examiner* — Jenine Pagan
(74) *Attorney, Agent, or Firm* — Sutherland Asbill & Brennan LLP

(57) ABSTRACT

The present application provides an ingredient release spout with an ingredient therein for use on a container. The ingredient release spout may include a cap with the ingredient therein and a nozzle. The cap may include a diaphragm with a capsule insert extending therefrom. The nozzle may include a cutting device therein such that rotating the cap pulls the diaphragm and the capsule insert towards the cutting device.

16 Claims, 27 Drawing Sheets

INGREDIENT RELEASE SPOUT

RELATED APPLICATIONS

The present application is a continuation-in-part of U.S. patent application Ser. No. 12/016,406, entitled "Ingredient Release Spout", filed on Jan. 18, 2008, now pending, which is a continuation-in-part of U.S. patent application Ser. No. 11/686,985, entitled "Ingredient Release Spout", filed on Mar. 16, 2007, now pending. U.S. patent application Ser. Nos. 12/016,406 and 11/686,985 are incorporated herein by reference in full.

TECHNICAL FIELD

The present application relates to a spout and an associated integrated capsule for setting this spout on the nozzles of different containers. This spout permits dispensing a separate substance in liquid or free-flowing form from this capsule into the container. This dispensing takes place automatically when the spout is opened for the first time so as also to provide a tamperproof seal.

BACKGROUND OF THE INVENTION

Numerous bottled drinks are manufactured today by mixing concentrates in large quantities of water, The drinks are then bottled and distributed. Instead of offering the drink in a final mixed form, it would be more efficient if the bottler could just fill a liquid, especially water, with the concentrate mixed with the liquid only when the consumer opens the bottle for the first time. For this purpose, the concentrate is added automatically into the liquid or in the water such that both are mixed when the consumer opens the bottle for the first time.

Moreover, functional probiotic beverages currently are experiencing significant growth. Although probiotic ingredients may be made shelf stable, the potency and desired consumer benefits may progressively lessen over time once exposed to a liquid if not adequately refrigerated. The ability to deliver such probiotic ingredients at the time of consumption thus would improve the overall consumer experience.

There is a desire, therefore, to produce a spout with an associated nozzle that provides for automatic dispensing of a separate substance into the container when the consumer opens the spout for the first time. The spout preferably maintains the ingredients therein in a shelf stable form until use.

SUMMARY OF THE INVENTION

The present application thus provides an ingredient release spout with an ingredient therein for use on a container. The ingredient release spout may include a cap with the ingredient therein and a nozzle. The cap may include a diaphragm with a capsule insert extending therefrom. The nozzle may include a cutting device therein such that rotating the cap pulls the diaphragm and the capsule insert towards the cutting device.

The present application further provides a method of releasing an ingredient from a spout with a diaphragm into a container. The method may include the steps of filling a cap of the spout with the ingredient, sealing the ingredient therein with a. sealing layer, placing the cap on a screw-on nozzle of the spout with a cutting device therein, placing the spout on the container, horizontally rotating the cap with respect to the screw-on nozzle such that the diaphragm allows the cutting device to cut the sealing layer, and flowing the ingredient into the container.

The present application further provides an ingredient release spout for use on a container. The ingredient release spout may include a cap, an ingredient, and a nozzle. The cap may include a diaphragm with a capsule insert extending therefrom and with the ingredient positioned within the capsule insert. The nozzle may include a cutting device therein such that rotating the cap pulls the diaphragm and the capsule insert towards the cutting device so as to release the ingredient into the container.

These and other features and improvements of the present application will become apparent to one of ordinary skill in the art upon review of the following detailed description when taken in conjunction with the several drawings and the appended claims.

BRIEF DESCRIPTION OF THE DRAWINGS

In the figures, the different variants of this spout are shown in different views. With the help of these figures, the spout is described in detail and its function is explained.

Fig, 13 is an exploded view of the individual parts of a third variant of the spout in the form of a sports or drink closure where the individual parts are aligned on their common axis.

Figure 13:
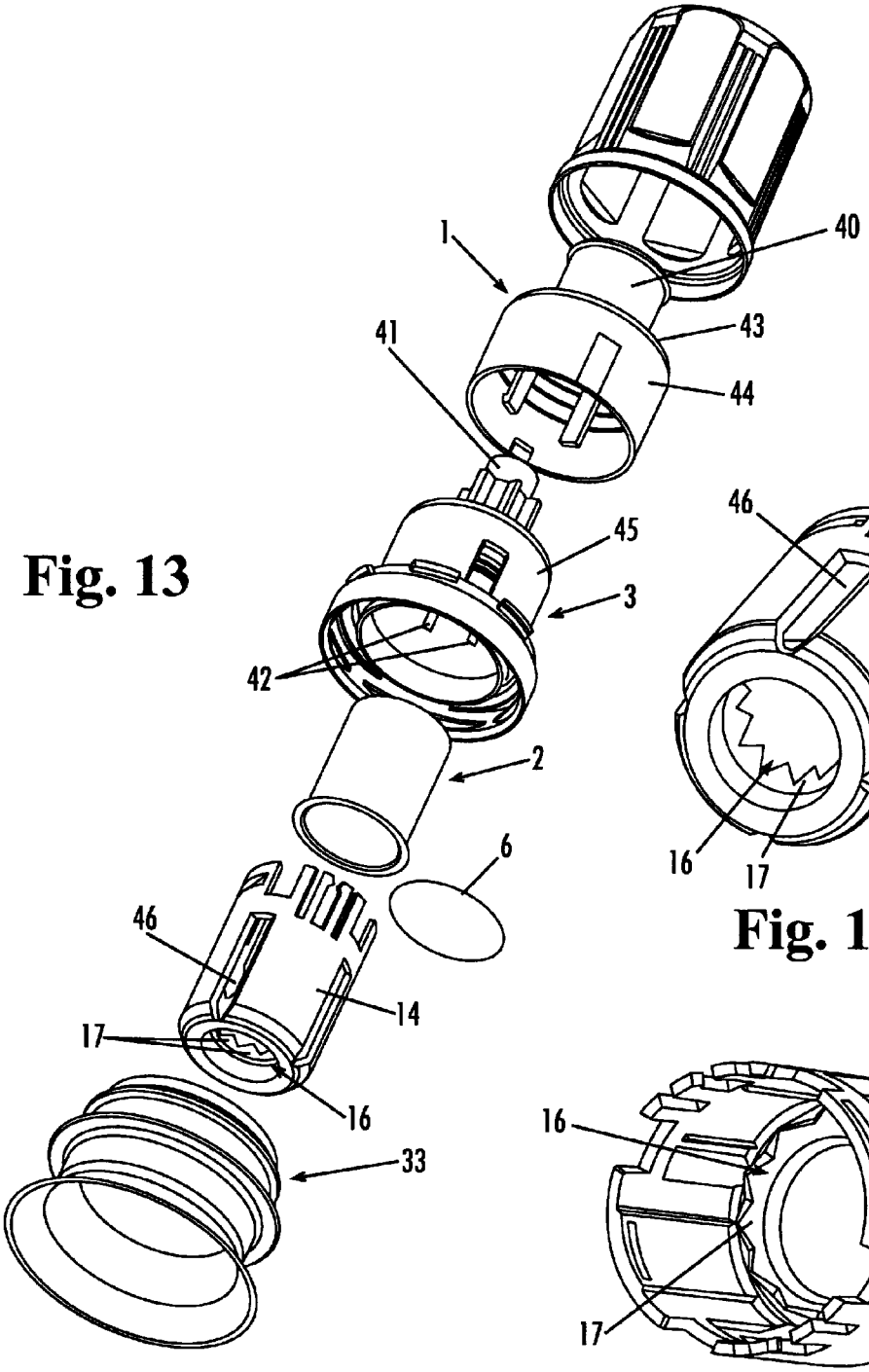
Figure 14:
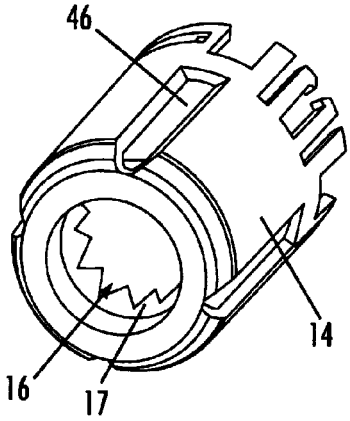

FIG. 14 is a perceptive view of the opening sleeve for the capsule belonging to the spout as per FIG. 13, viewed diagonally from below.

Figure 15:
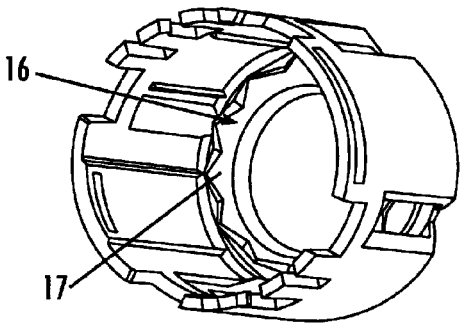

FIG. 15 is a perspective view of the opening sleeve for the capsule belonging to the spout as per FIG. 13, viewed diagonally from above.

Figure 16:
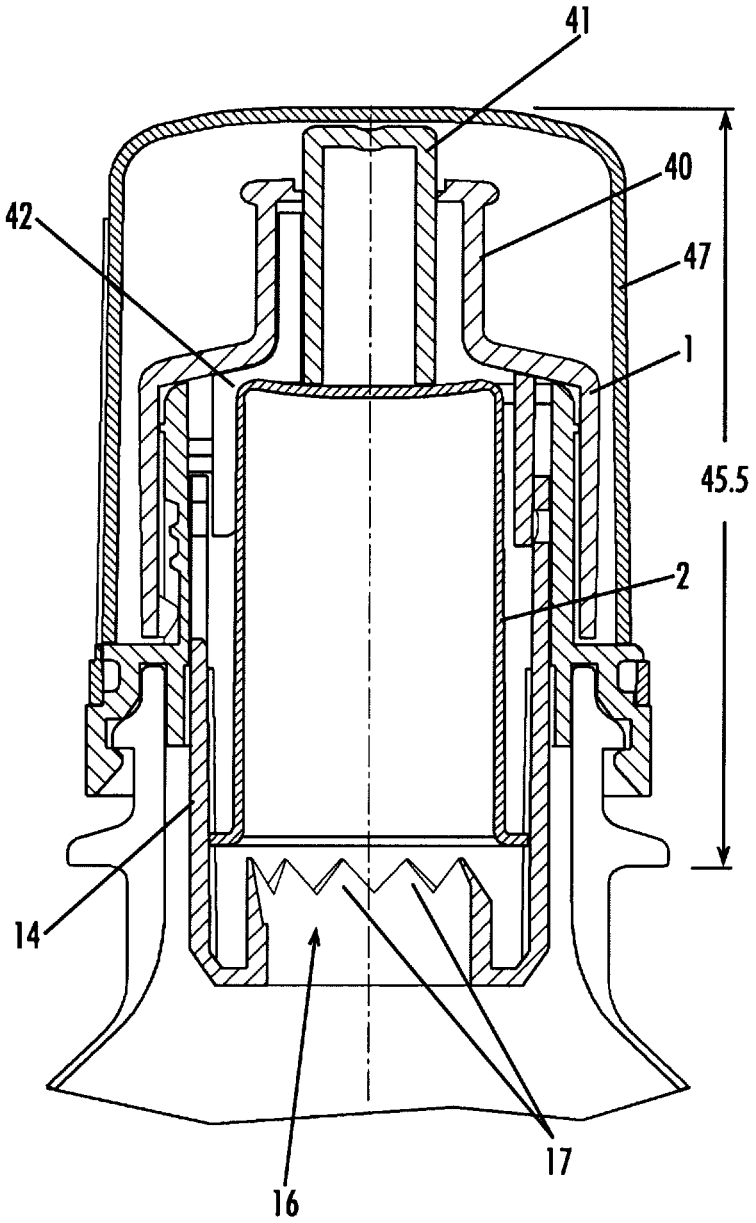

FIG. 16 is a cross-sectional view of the spout as per FIG. 13 taken along its axis, in a mounted and closed, but not yet opened state.

Figure 17:
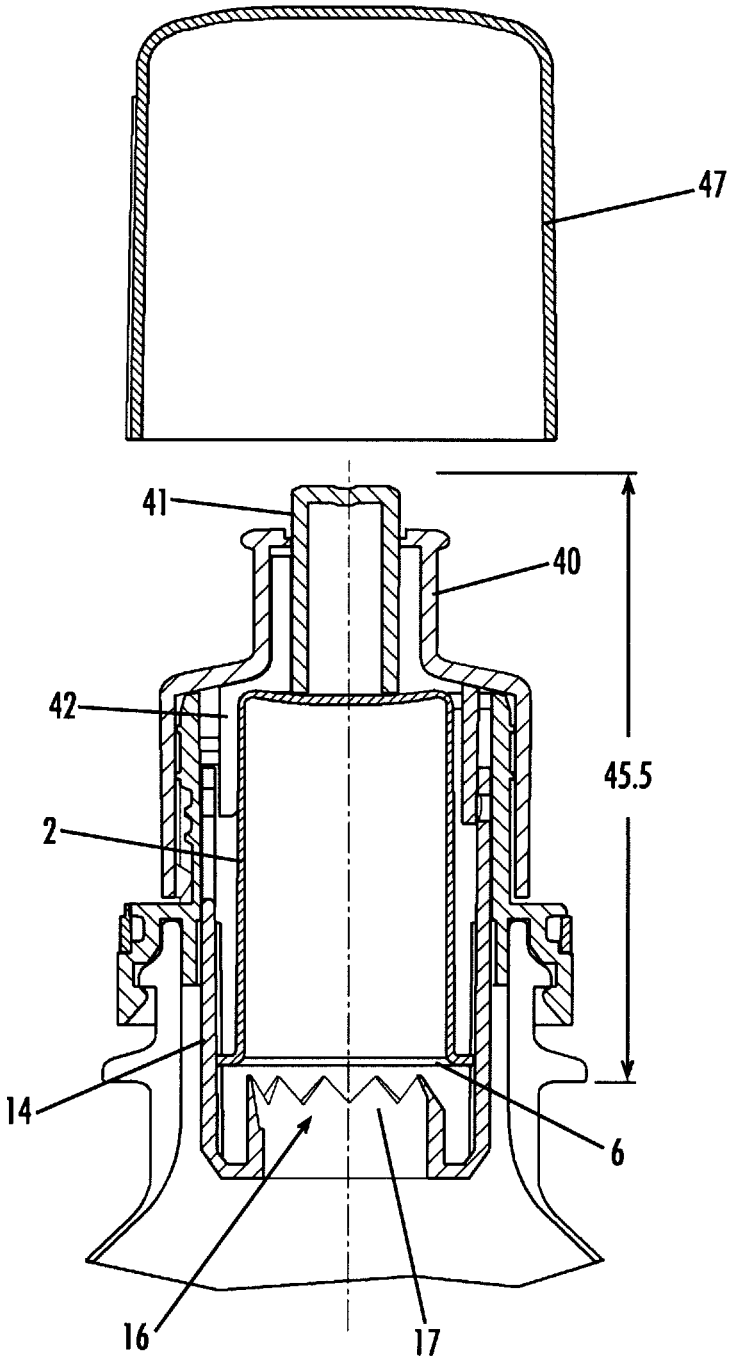

FIG. 17 is a cross-sectional view of the spout as per FIG. 13 taken along its axis, with the protective cap removed, before the dispensing of the substance in the capsule.

Figure 18:
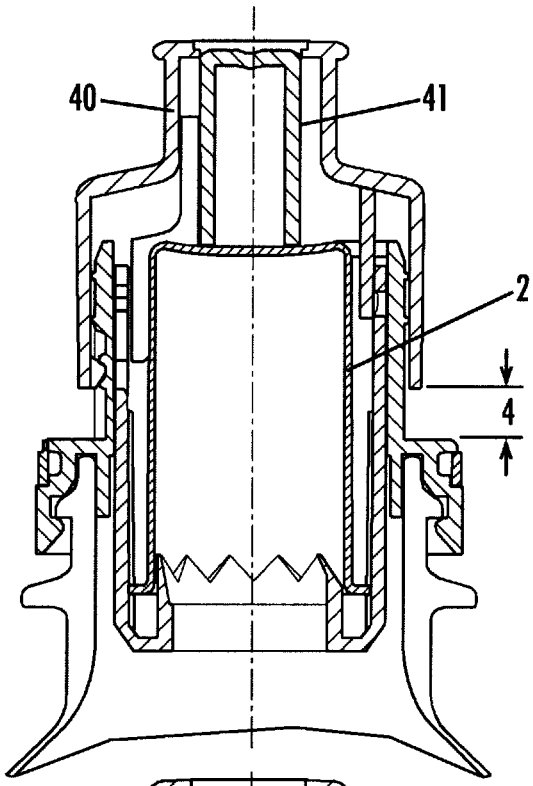

FIG. 18 is a cross-sectional view of the spout as per FIG. 13 taken along its axis, after pressing down the stopper and thus opening the capsule and dispensing its contents in the container, however, in the closing position of the drinking nozzle.

Figure 19:
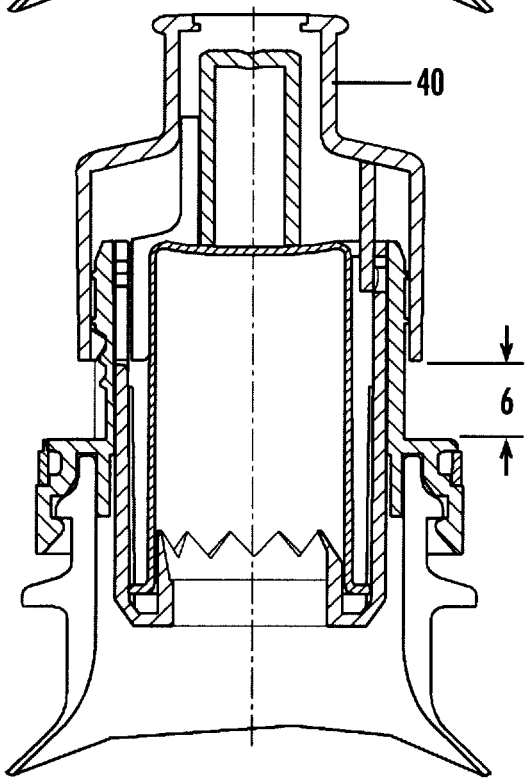

FIG. 19 is a cross-sectional view of the spout as per FIG. 13 taken along its axis, after pressing down the stopper and thus opening the capsule and dispensing its contents in the container, now in the open position of the drinking nozzle.

Figure 20:
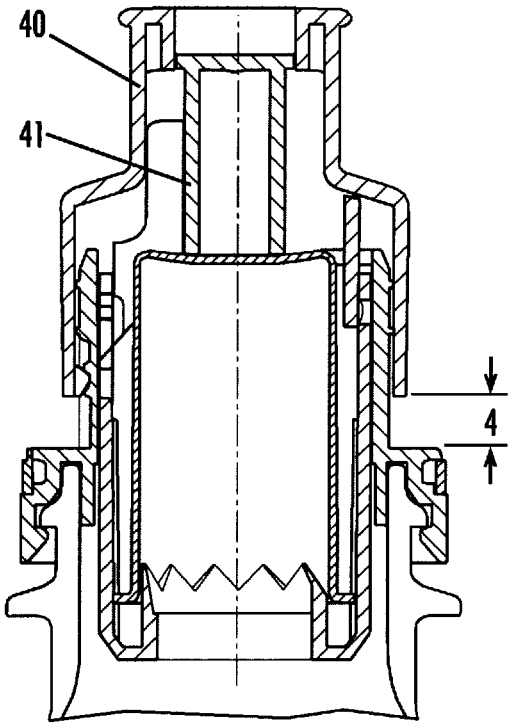

FIG. 20 is a cross-sectional view of the spout as per FIG. 13 with the drink nozzle in this close position having an extended design.

Figure 21:
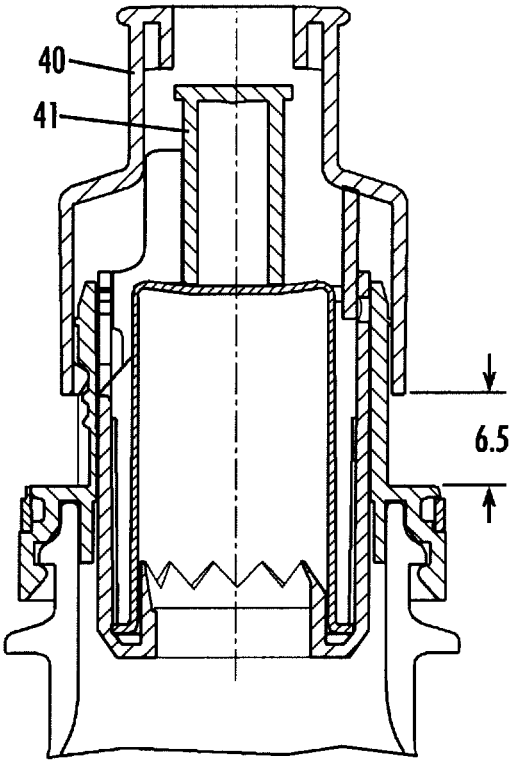

FIG. 21 is a cross-sectional view of the spout as per FIG. 20 with the drinking nozzle in the open position.

Figure 22:
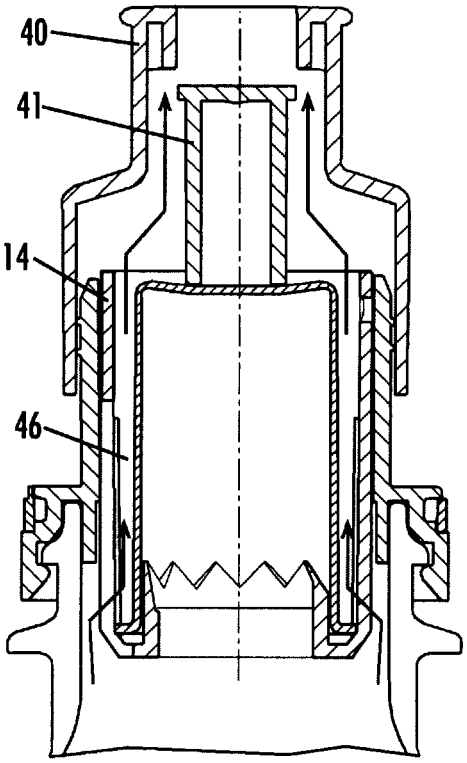

FIG. 22 is a cross-sectional view of the spout as per FIG. 20 with the drinking nozzle in the open position, but rotated by a few angular degrees, so that the path of the liquid flowing out is visible.

Figure 23:
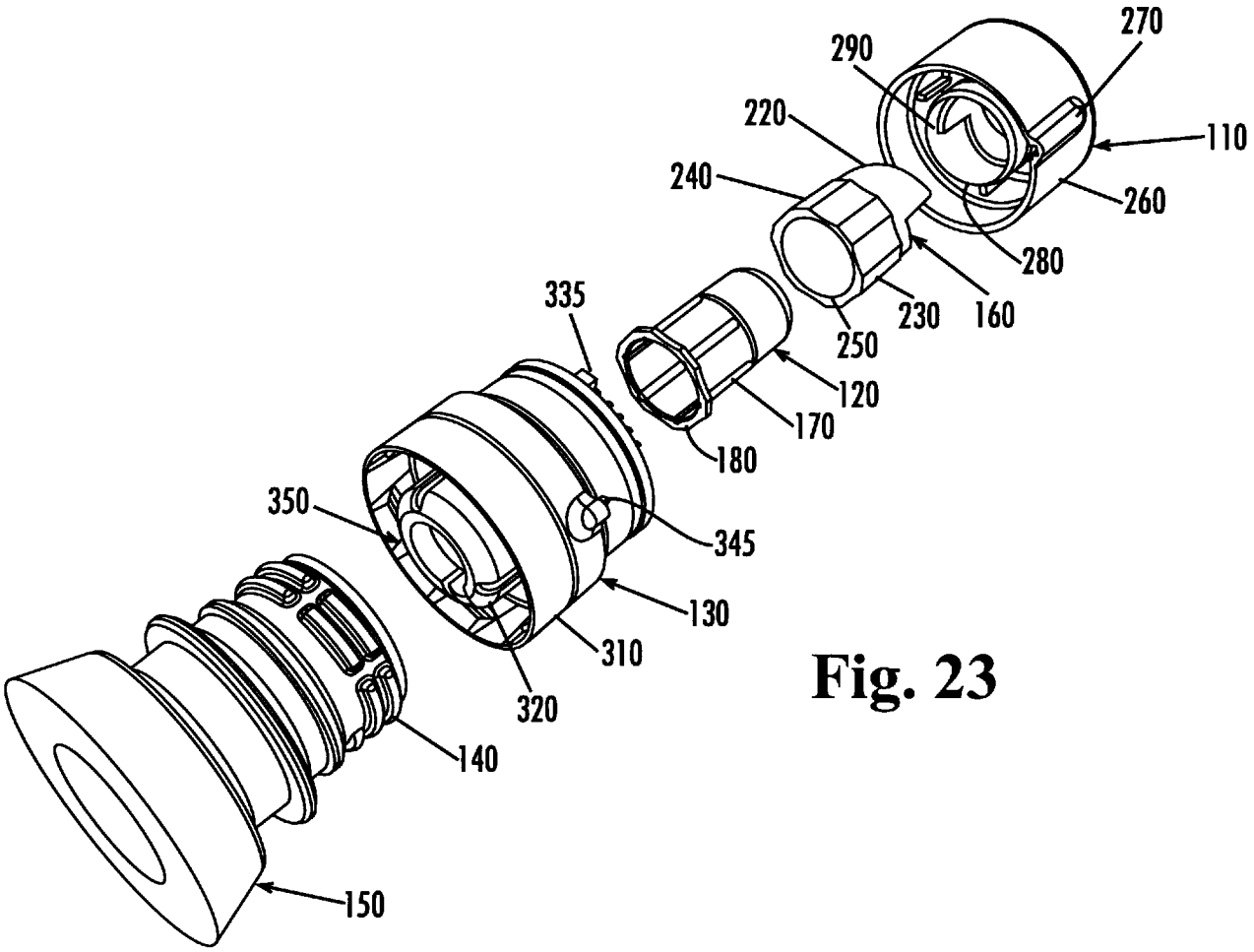

FIG. 23 is an exploded view of the individual parts of a fourth variant of the spout with a rotating cap, a capsule, a nest, and a screw on nozzle and a container bottle viewed diagonally from above.

Figure 24:
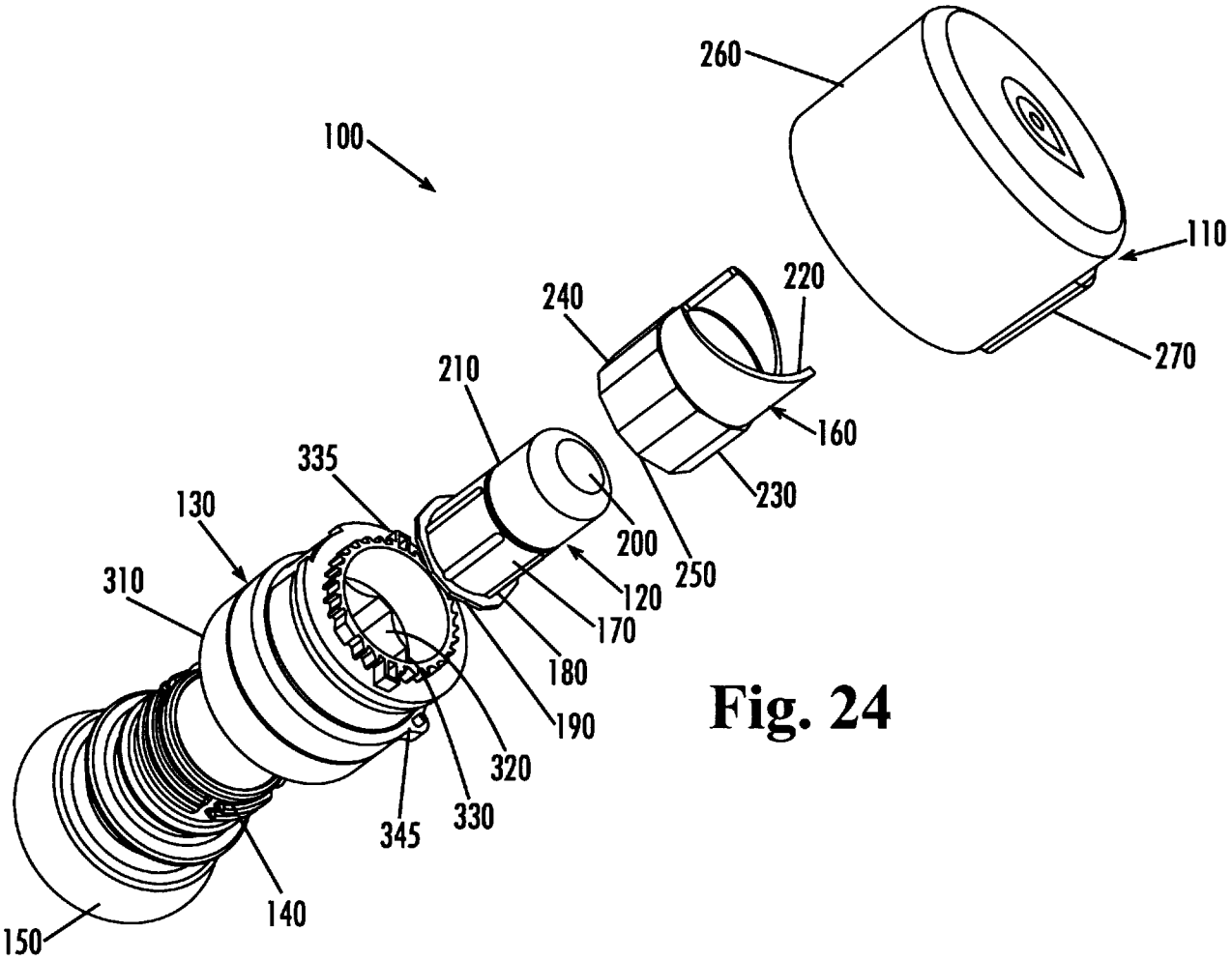

FIG. 24 is an exploded view of the individual parts of the spout with a rotating cap, a capsule, a nest, and a screw-on nozzle on a container bottle viewed diagonally from below.

Figure 25:
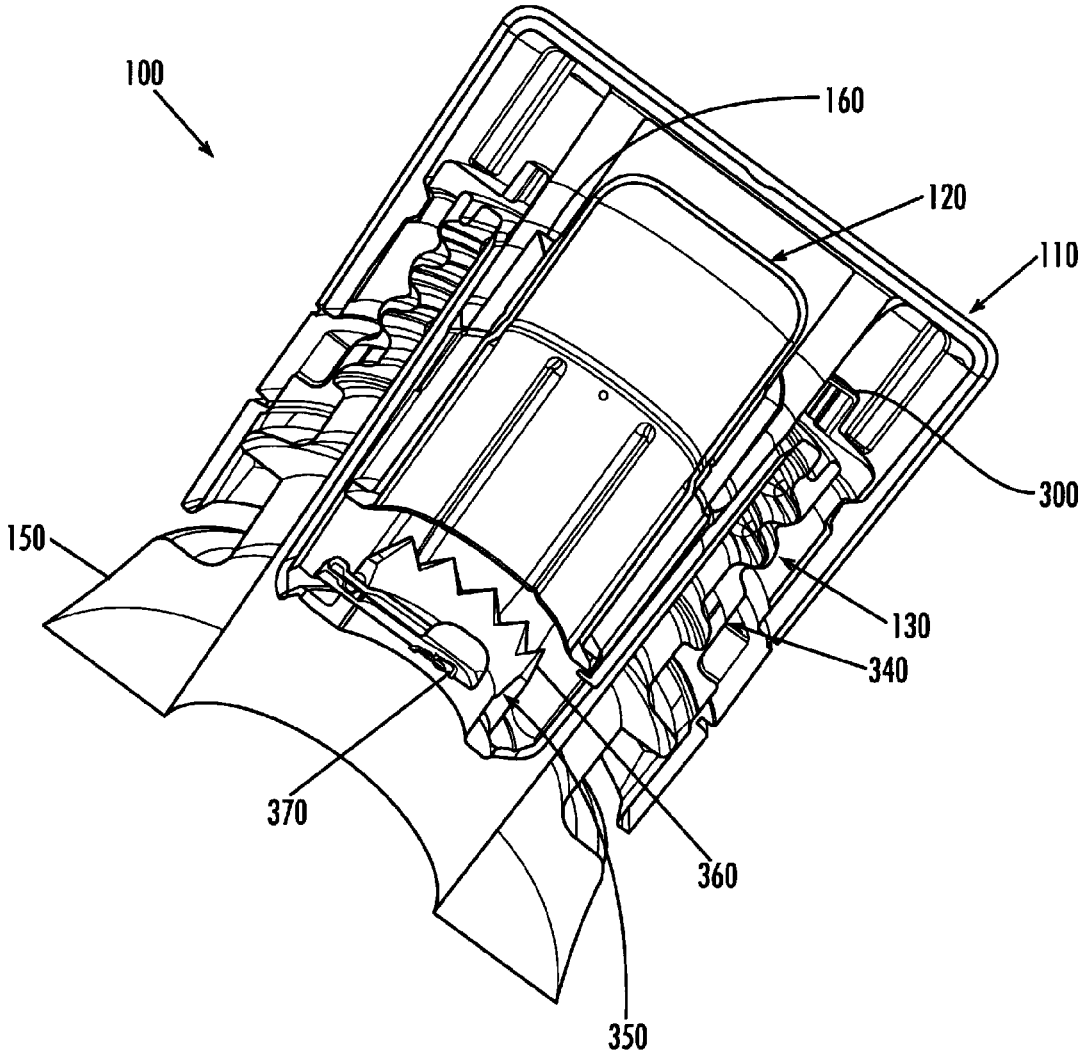

FIG. 25 is a side cross-sectional view of a spout as is described herein in the raised position.

Figure 26:
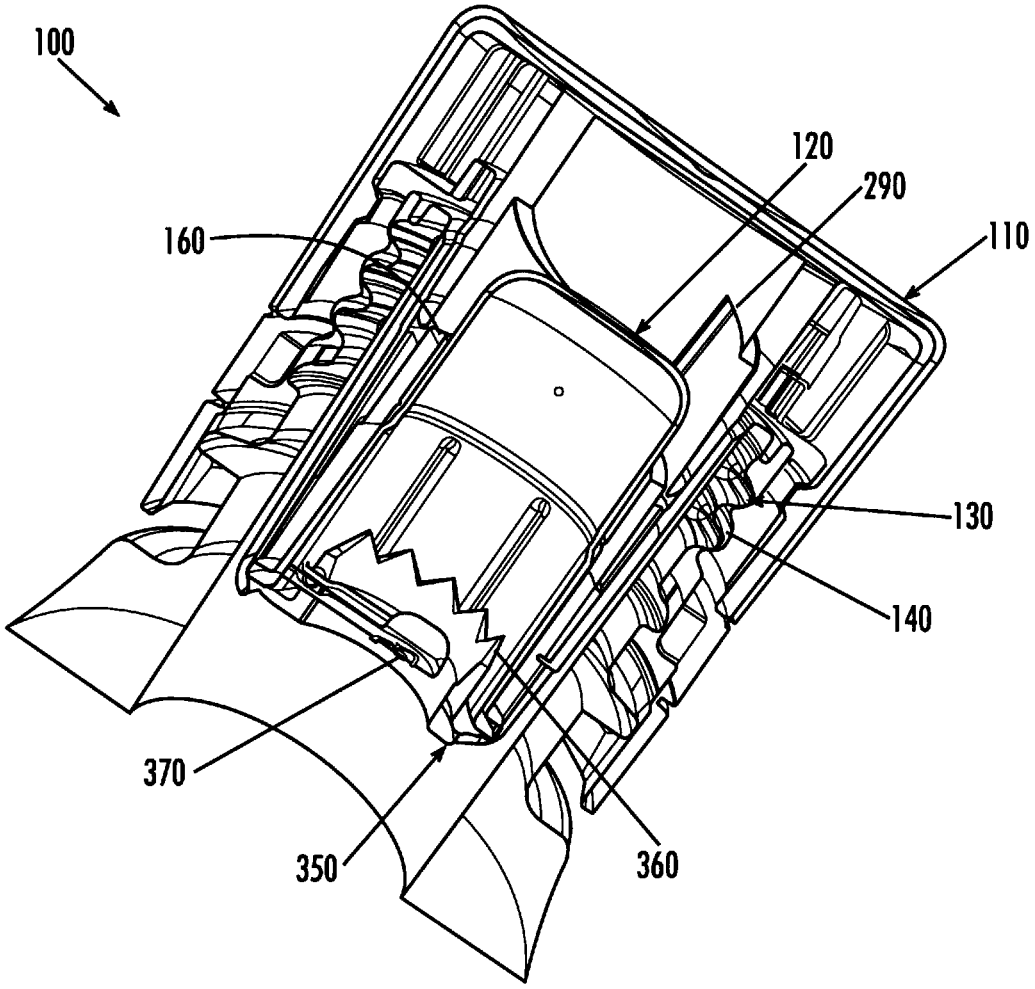

FIG. 26 is a side cross-sectional view of the spout of FIG. 25 in the lowered position.

Figure 27:
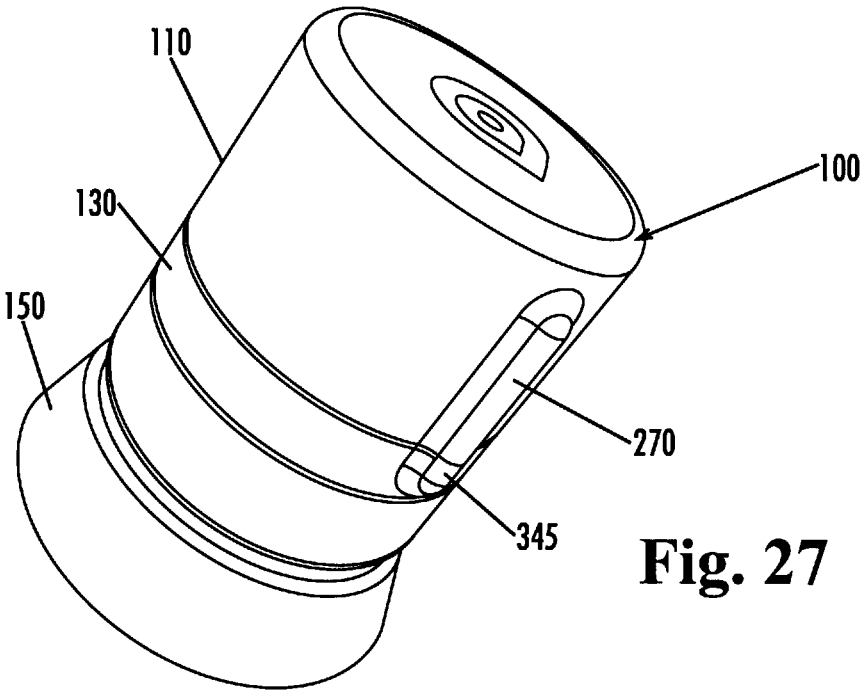

FIG. 27 is a perspective view of the spout as placed on a container.

Figure 28:
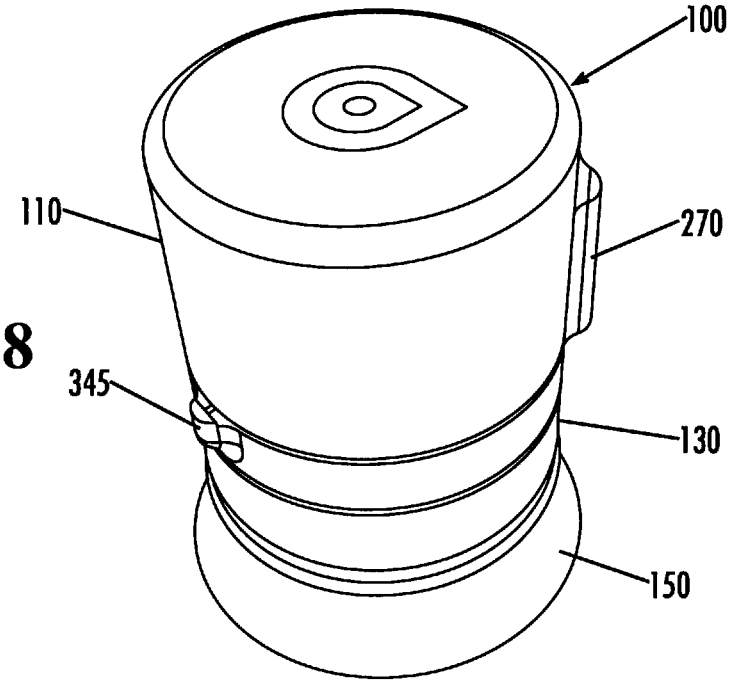

FIG. 28 is a further perspective view of the spout as placed on a container.

Figure 29:
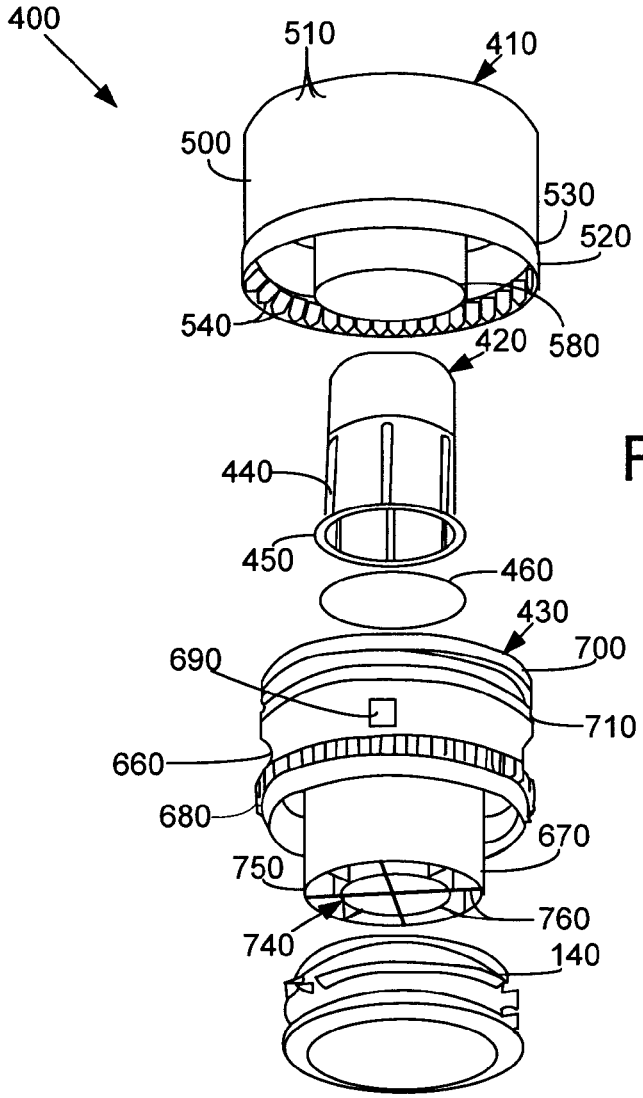

FIG. 29 is an exploded view of the individual parts of a fifth variant of the spout with a rotating cap, a capsule, and a screw-on nozzle on a container bottle viewed diagonally from below.

Figure 30A:
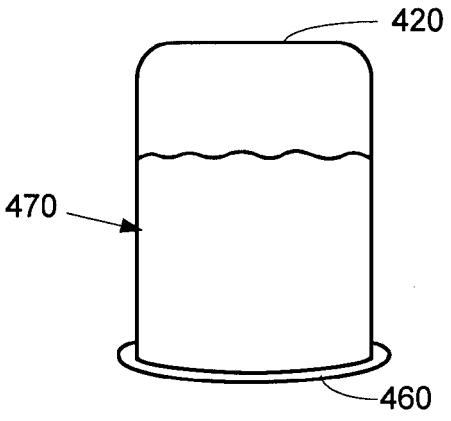

FIG. 30A is a side plan view of a capsule with a fluid therein.

Figure 30B:
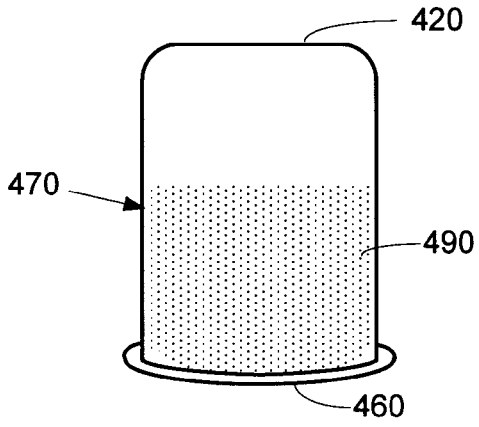

FIG. 30B is a side plan view of a capsule with a powder therein.

Figure 31:
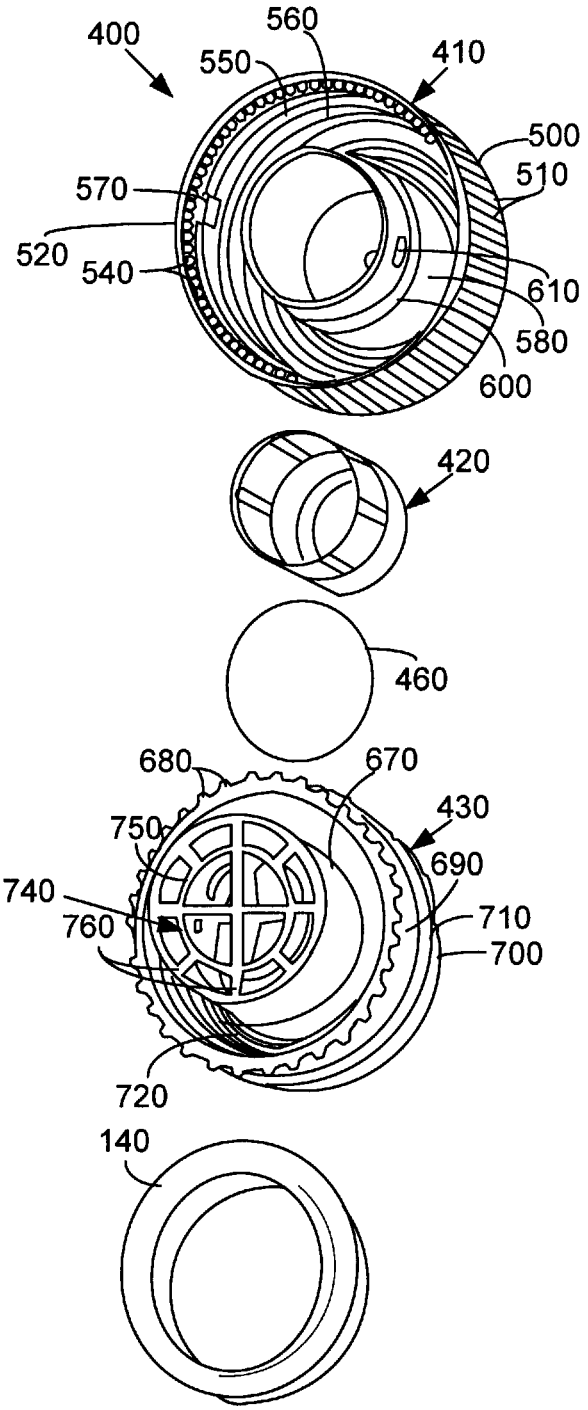

FIG. 31 is a bottom side exploded view of the spout of FIG. 29.

Figure 32:
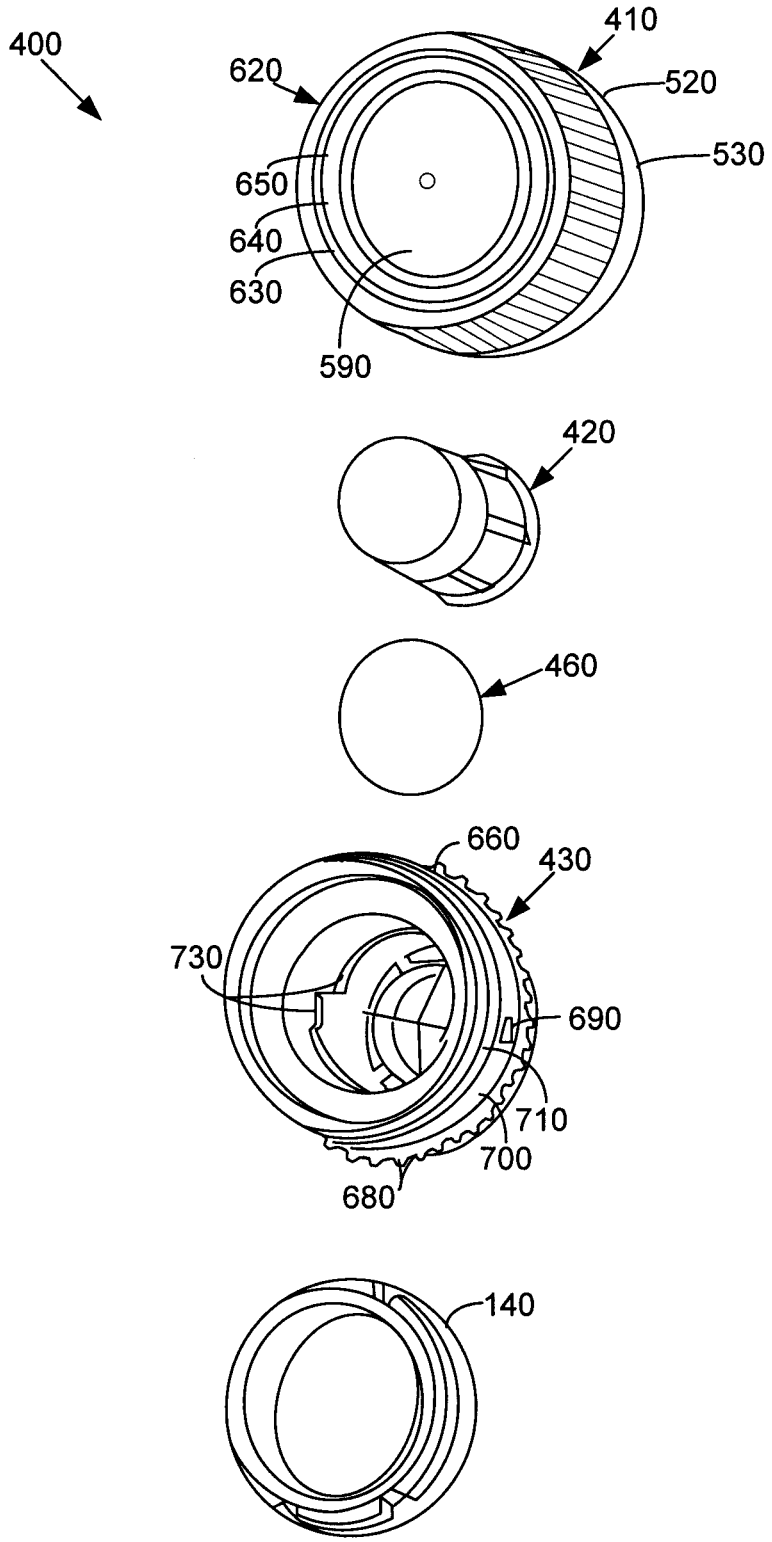

FIG. 32 is a top side exploded view of the spout of FIG. 29.

Figure 33:
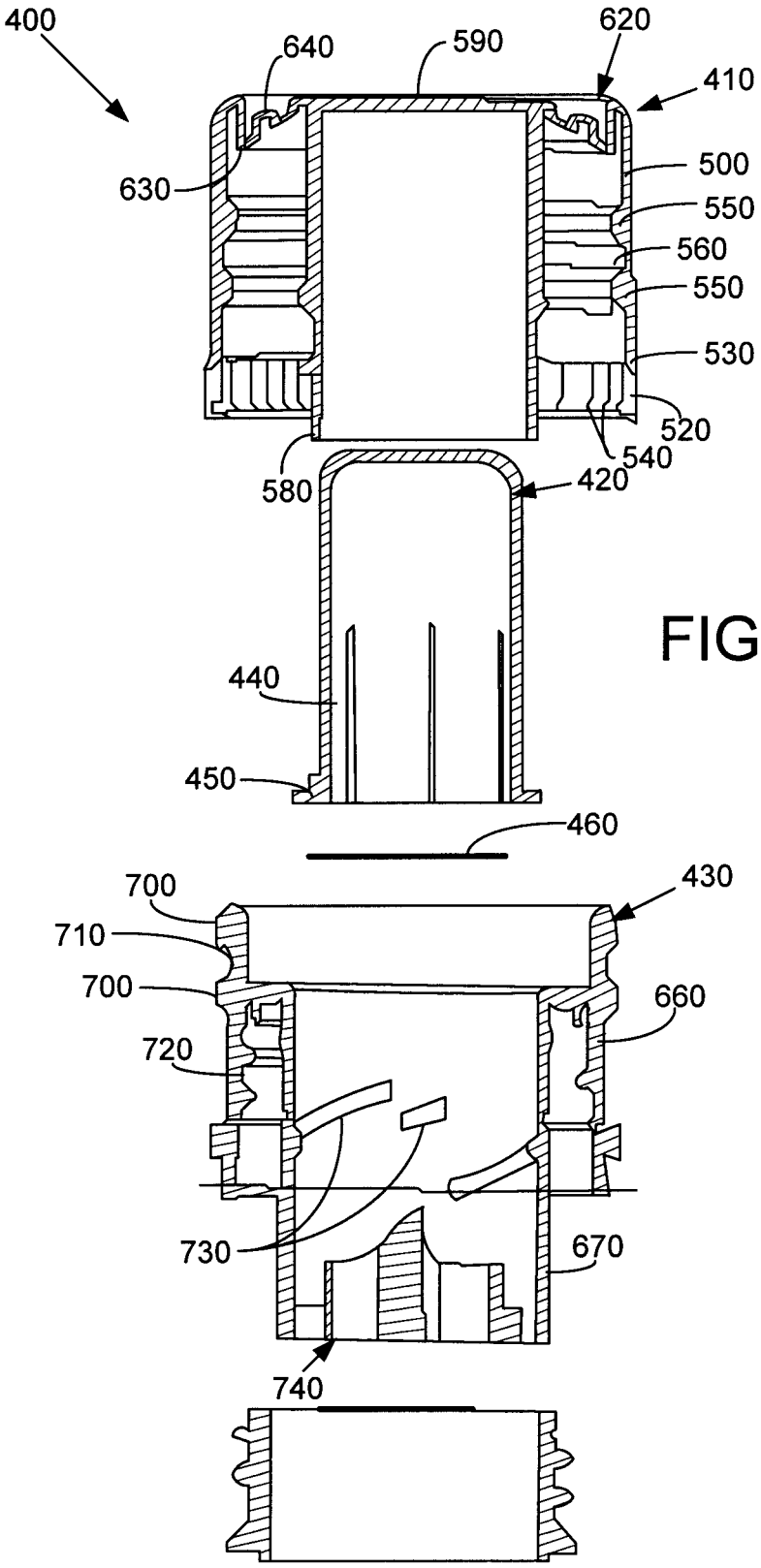

FIG. 33 is a side cross-sectional view of the spout of FIG. 29.

Figure 34:
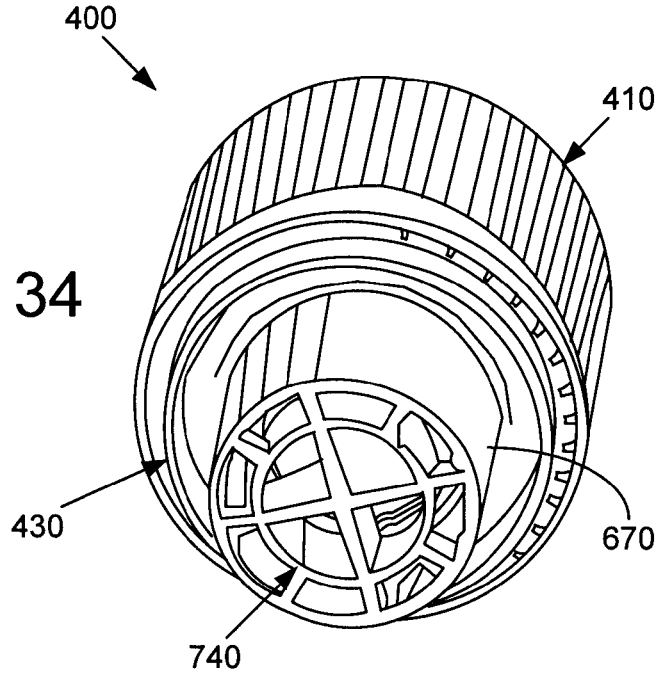

FIG. 34 is a bottom perspective view of the spout of FIG. 29.

Figure 35:
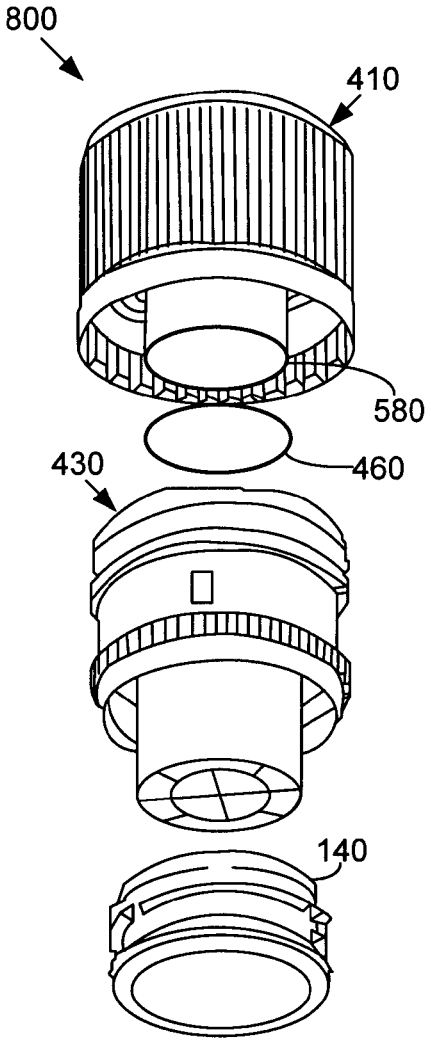

FIG. 35 is an exploded view of the individual parts of a sixth variant of the spout with a rotating cap and a screw-on nozzle on a container bottle viewed diagonally from below.

DETAILED DESCRIPTION

A common feature of all of the variants of the spout presented here is that they contain a capsule with a separate substance. The substance may be a liquid, a solid such as a powder, or any substantially flowable substance. The capsule is opened when the spout is opened for the first time such that the substance falls down in the container lying below it. Another common feature is that this capsule is arranged in an overturned position inside the spout. This means that the fixed base of the capsule lies on the top and its open side, sealed with a sealing foil, lies on the bottom. The capsule is present inside the container nozzle or at least protrudes inside it to a large part. The lower edge of the spout generally lies below the upper margin of the container nozzle or the container neck.

To open the capsule, this foil is automatically pierced or cut with a special opening device such that the contents of the capsule fall down into the container. Depending upon the design of the spout, this opening device may be inside the cap or the screw-on nozzle and is pushed downwards in a translatory way and is pressed over the sealing foil. Alternatively, the capsule is pushed downwards by means of a rotating movement along a helix such that its sealing foil is then cut after being pierced by the stationary opening device upon a further rotary movement along the helix. Other configurations also are described herein.

Figure 1:
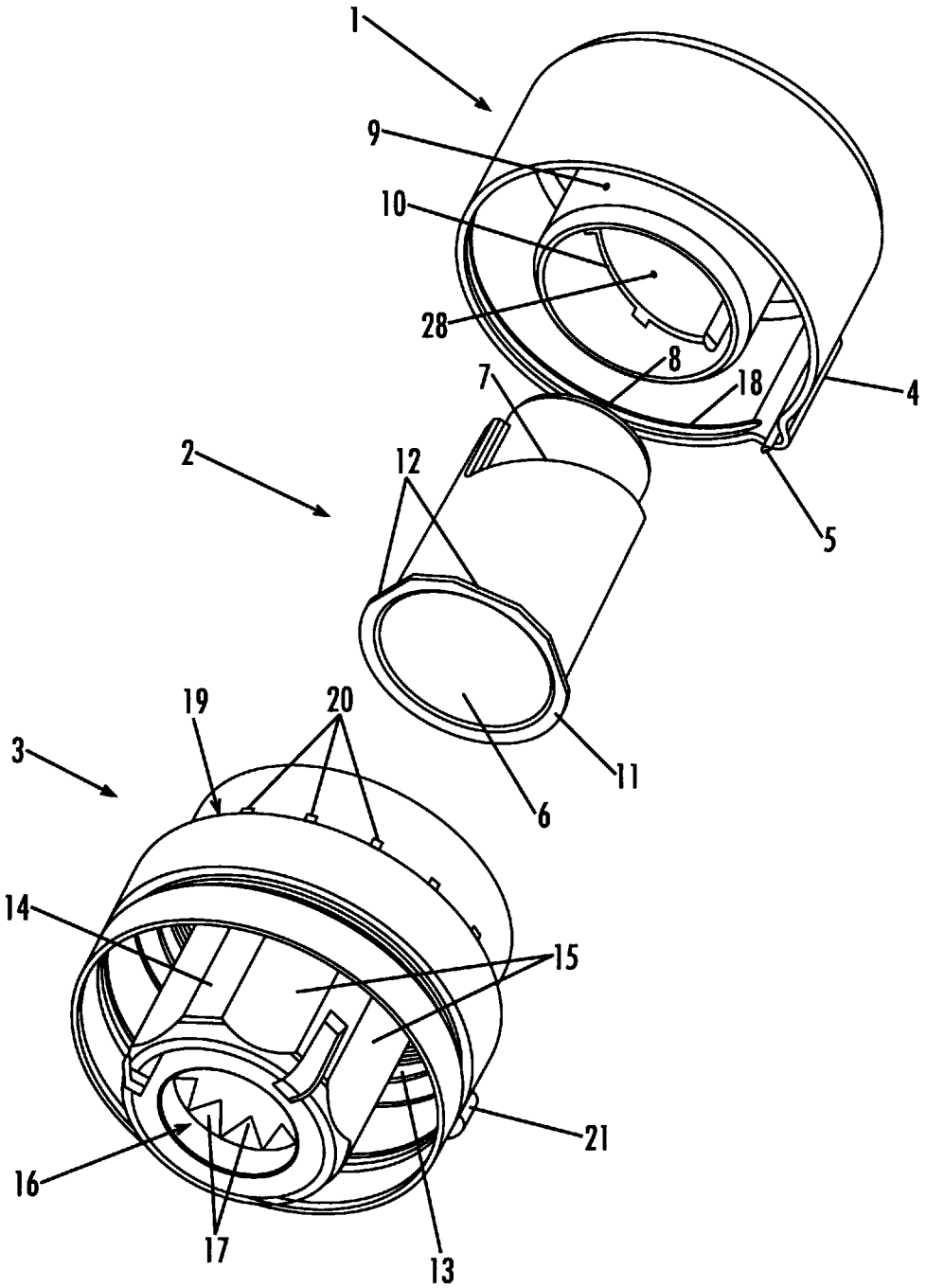
FIG. 1 is an exploded view of the individual parts of a first variant of a spout with a rotating cap, a capsule, and a screw-on nozzle with opening sleeve shown separately, viewed diagonally from below.

FIG. 1 shows the individual parts of the first variant of this spout with a rotating cap 1, a capsule 2, and a screw-on nozzle 3 with an opening sleeve 14. One can see here the parts diagonally from below. The parts may be made from plastics, metallics, or any other convenient material. On the top or on the right, one sees the rotating cap 1 of the spout. On one side of its peripheral wall may be a bulge 4. There is a shear pin 5 in this bulge 4 that protrudes a little above the bulge 4 and which acts as the tamperproof guarantee. Below this one can see the cylindrical capsule 2. The capsule 2 is open on the bottom and is sealed with a sealing foil 6 after it is filled. In the peripheral wall is a helical collar 7 that acts as a sliding curve, as will be explained later. The capsule 2 can be inserted with its base 8 forward into a guide sleeve 9 inside the cap 1 and fixed in a concentric position to the cap 1. The upper part of the capsule 2 then lies in the inside of this guide sleeve 9 on the cap base, within which a guide sleeve 28 with a helical margin 10 is formed. By setting the capsule 2 in this guide sleeve 28, the helical collar 7 closes so as to form the sliding curve at the capsule 2 in a form-fitting way to the helical margin 10 of this guide sleeve 28 inside the guide sleeve 9. At the lower end of the capsule 2, this runs out in a laterally projecting edge 11 that has several straight sections 12 on the outside around its periphery. Below the capsule 2, the screw-on nozzle 3 can be seen. On its lower inner side is an inner thread 13, with which it can be screwed on the outer thread of a container nozzle. The container may be a bottle made of glass or plastic. Likewise, the container may be a plastic container, a carton, a steel canister with plastic nozzles, and the like.

Inside the screw-on nozzle 3, an opening sleeve 14 runs concentrically and is connected with the upper margin of the screw-on nozzle 3 on the top with a material bridge. This opening sleeve 14 shows, in the given example, several plane side bands 15. The capsule 2 thus can he inserted in the opening sleeve 14 from the top in such a way that it is straight or the plane sections 12 on its lower projecting edge 11 lie opposite these plane side bands 15 of the opening sleeve 14. In this way, the capsule 2 is protected against slipping inside the opening sleeve 14 and can move in only a translatory way along the axis of rotation of the screw-on nozzle 3. At the lower end of the opening sleeve 14, it shows a piercing and cutting device 16 with piercing and cutting teeth 17 projecting upward on the inner side of the opening sleeve 14. During the course of mounting, the cap 1 is forced on to the screw-on nozzle from the top under inclusion of the filled capsule 6 and sealed on the lower side with the sealing foil 6. Inside the cap 1, a groove 18 runs along its lower edge. The screw-on nozzle, on the other hand, forms a collar 19 on which radial outstanding cams 20 are formed. The cap 1 thus can be pressed on these cams 20 with its inner lying groove 18, which then snap in the groove 18. Thereafter, the cap 1 is held firmly on the screw-on nozzle 3, but can be rotated thereon. The rotating position of the cap 1 is thereby selected in such a way that its shear pin 5 engages in a corresponding accommodation the hole 21 on the outer side of the screw-on nozzle 3.

Figure 2:
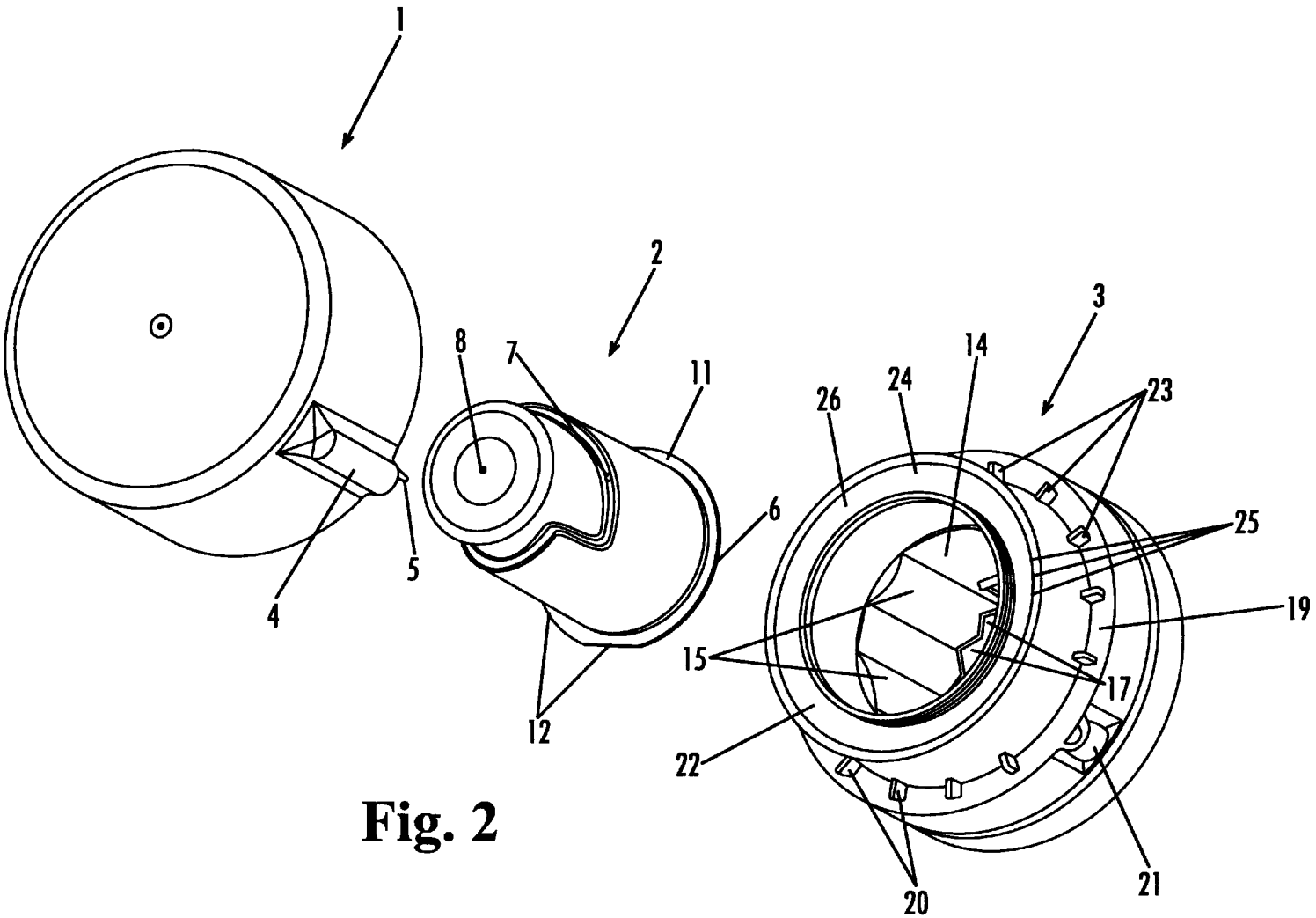
FIG. 2 is an exploded view of individual parts of this first variant of the spout with a rotating cap, a capsule, and a screw-on nozzle with opening sleeve shown separately, viewed diagonally from above.

FIG. 2 shows the parts of this first variant of the spout with the rotating cap 1, the capsule 2, and the screw-on nozzle 3 with the opening sleeve 14, seen diagonally from above. One can see here the bulge 4 at the cap margin with the shear pin 5 projecting downward. Below the rotating cap 1, the overturned capsule 2 is shown. The helical collar 7 of the cap base 8 forms a slide curve that acts together with the helical margin 10 of the guide sleeve 28 inside the cap 1 for opening the capsule 2. This guide sleeve 28 can be seen in FIG. 1. Below the capsule 2, the radial projecting edge 11 can be seen, which shows straight or plane sections 12. Below the capsule 2, one can see the screw-on nozzle 3 with the collar 19 and the snap-on cams 20 aligned radially to the outside. On their outermost front side, each of these shows a nose 23 which fits in the groove 18 on the inner side of the cap wall. The shear pin 5 at the lower edge of the cap edge fits into the opening 21 on the outside at the screw-on nozzle 3. The tamper proof guarantee is provided that upon rotating the cap 1 placed on the screw-on nozzle 3, the shear pin 5 fitting in this opening 21 breaks. Alternatively, the opening 21 includes a weak point on its right side that is pierced by the pin 5 that acts as a powerful bolt.

The capsule 2 can thus be placed in the screw-on nozzle 3 or in the opening 14, so that its flat margins 12 on the edge 11 lie opposite to the plane sections 15 inside the opening sleeve 14. It is then held firmly inside the opening sleeve 14. In the lower area of the opening sleeve 14, one can see the piercing and cutting teeth 17 projecting upward. Above on the screw-on nozzle 3 between its outer side and the opening sleeve 114, a material bridge 22 is present that carries the opening sleeve 14 freely hanging inside the screw-on nozzle 3. This bridge forms a peripheral groove 24. In a region that extends by about one-fourth to one-third or more of the circumference of this groove 24, its outer limiting wall is provided with a series of barbs 25. These barbs 25 act together with a handle 27 that sticks out on the lower side of the cap 1 and is visible in FIG. 3. Together with these barbs 25, this handle 27 forms a ratchet. This ensures that the cap 1 can be rotated only in the counter-clockwise direction from its starting position and that this rotation is restricted by a cross-plate 26 in the groove 24. When the cap 1 is rotated so far once, the handle 27 at the cap 1 is stopped at the cross-plate 26. The cap 1 then can no longer be rotated back from this end position because of the barbs 25.

Figure 3:
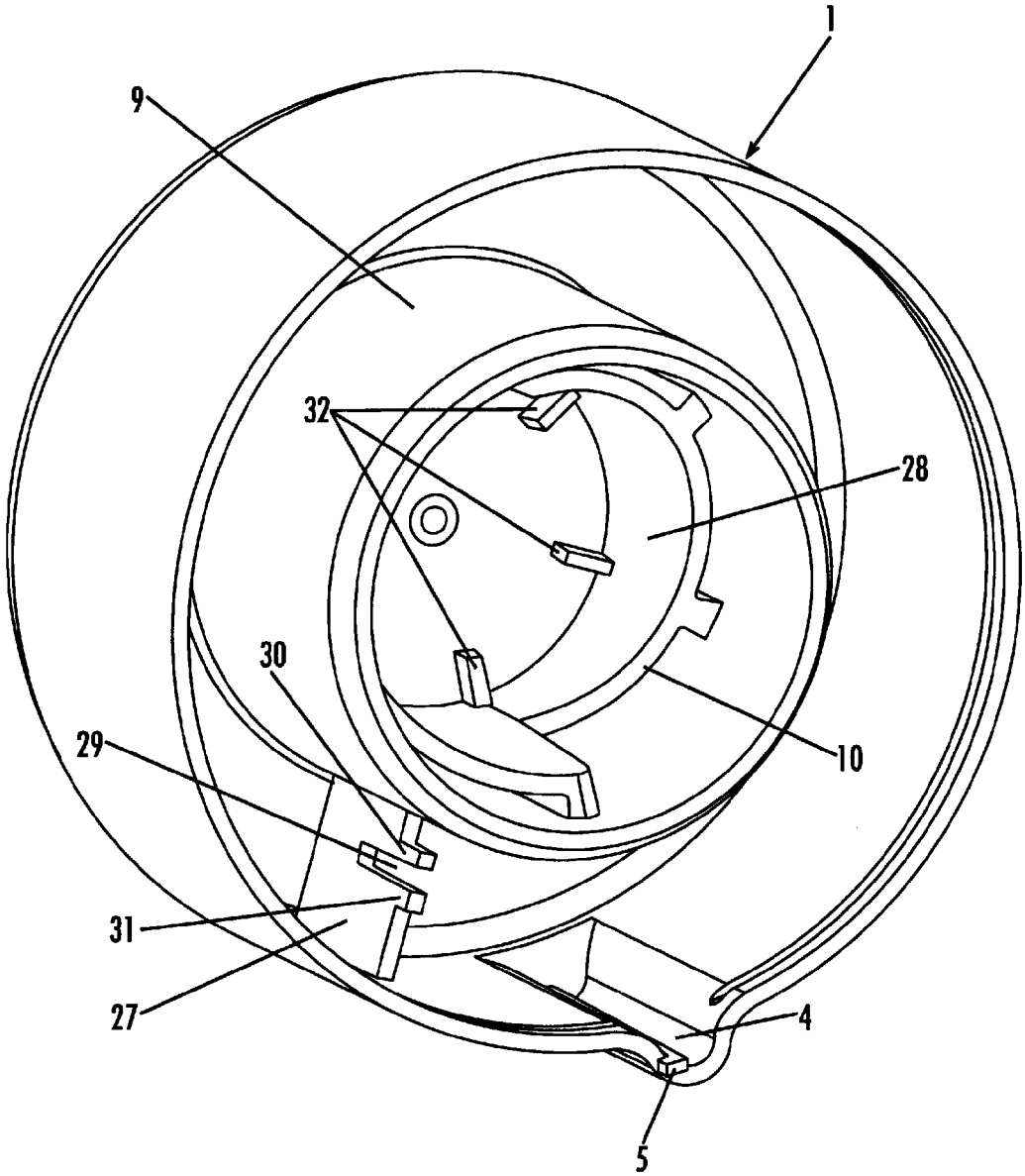
FIG. 3 is a perspective view of the rotating cap viewed diagonally from below in a magnified view.

FIG. 3 shows the rotating cap 1 diagonally from below in a magnified view. One can see the handle 27 that is formed between the outer wall of the cap 1 and the sleeve 9 and within which the guide sleeve 28 is formed with its helical outer margin 10. This handle 27 runs in two cams 30, 31 aligned in axial direction and separated by a slit 29. When the cap 1 is placed over the screw-on nozzle 3 and is rotated in the direction of opening, the inner cams 30 slide along the inner limiting wall of the groove 24 while the outer cams 31 slide over the barbs 25 at the outer limiting wall of the groove 24. The slit 29 between both the cams 30, 31 allows the cam 31 to yield a little against the center of the cap 1 and hence maneuver above the barbs 25. The cam 31 then jumps back behind each barb 25 and slides again along the length of the outer limiting wall of the groove 24 until the handle 27 finally comes to a stop at the cross-plate 26 in the groove 24. In this display of the cap 1, one can see also the shear pin 5 in the bulge 4 as well as the guide sleeve 28 with two sections of helical edges 10. The radial ribs 32 on the base of the cap are used for positioning the capsule 2 when it is inserted with its base on the front inside the cap. The base of the capsule then stands on these ribs 32.

Figure 4:
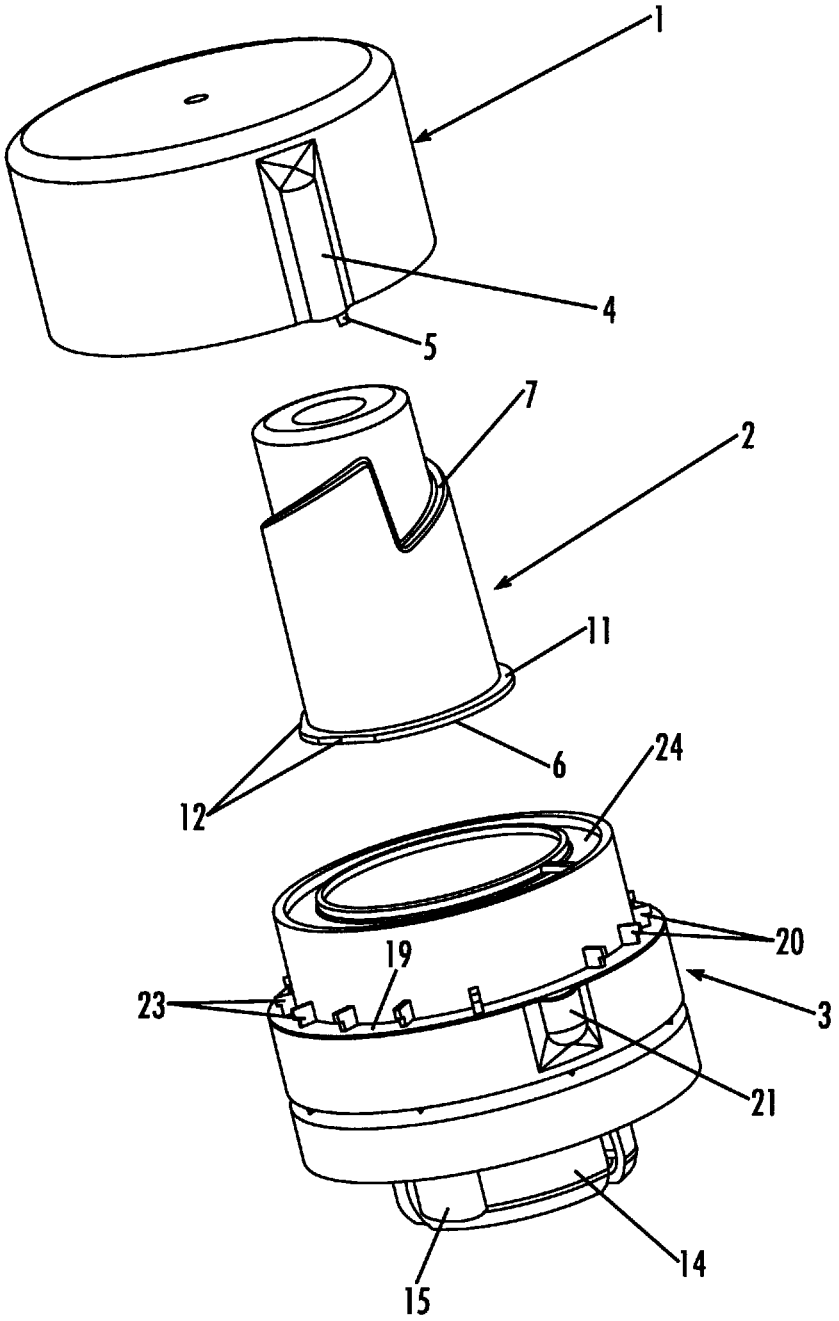
FIG. 4 is an exploded view of the individual parts of this first variant of the spout with a rotating cap, a capsule, and a screw-on nozzle with opening sleeve shown separately, viewed laterally.

FIG. 4 shows the individual parts of this first variant of the spout with the rotating cap 1, the capsule 2, and the screw-on nozzle 3 with an enclosed opening sleeve 14 displayed separately. The helical collars 7 fit over the capsule 2. The capsule 2 disappears with the assembly of the spout inside the screw-on nozzle 3. The plane sections 12 and their protruding edge 11 are led along the plane sections 15 inside the opening sleeve 14 and held firmly therein. In this position, the sealing foil 6 of the capsule is present just above the piercing and cutting teeth 17 at the lower edge of the opening sleeve 14. if the cap 1 is rotated in the direction of the opening, then the capsule 2 must remain in the same rotational position within the opening sleeve 14 while the cap 1 rotates around it. Thereby the helical edges 10 of the guide sleeve 28 inside the cap 1 act on the slide curves of the capsule 2 and push the capsule 2 in a translatory movement downwards within the opening sleeve 14. Thereby, the sealing foil 6 of the capsule 2 is pressed above the piercing and cutting teeth 17 present around the opening sleeve 14. The piercing and cutting teeth thus pierce the sealing foil 6 along its marginal area and cut it such that that the contents of the capsule fall into the container.

Figure 5:
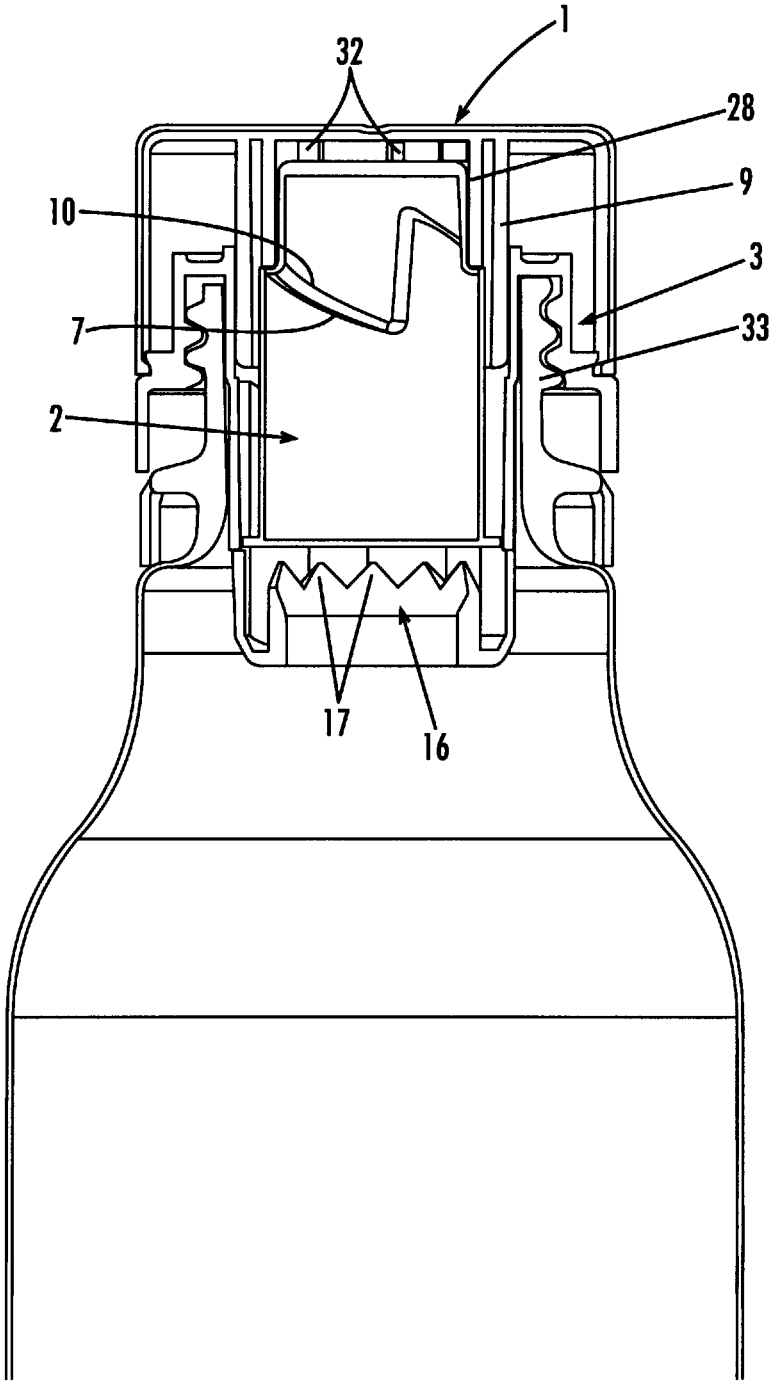
FIG. 5 is a cross-sectional view of the individual parts taken longitudinally along the axis of rotation of the rotating cap, of the capsule, and of the screw-on nozzle with opening sleeve.

FIG. 5 shows the parts of this spout assembled, in a cross-section along the axis of rotation of the rotating cap 1, the capsule 2, and the screw-on nozzle 3 with the opening sleeve 14. The nozzle 3 is screwed on a container nozzle 33. In this display, one sees how the capsule 2 with its helical collar 7 lies as the slide curves 7 at the helical edges 10 of the guide sleeve 28. When the cap is rotated, these edges 10 are rotated over the slide curves at the capsule 2 and force the capsule 2 to move downwards. The capsule 2 is thus pushed downwards within the opening sleeve 14 and its sealing foil 6 is thereby pressed over the piercing and the cutting device 16 so as to pierce the foil and cut it. The contents of the capsule then fall in the container. If the cap 1 is now rotated further, which requires a larger torque, then the nozzle 3 is loosened out from the external thread of the container nozzle 33 until the complete spout made of the cap 1, the capsule 2, and the nozzle 3 is removed from the container. The container is then ready for its contents to be poured out, which is now mixed with the substance of capsule 2. After pouring out one dose or the required quantity, the spout with the screw-on nozzle 3 can be screwed back again on the container nozzle 33 like a conventional threaded cap.

Figure 6:
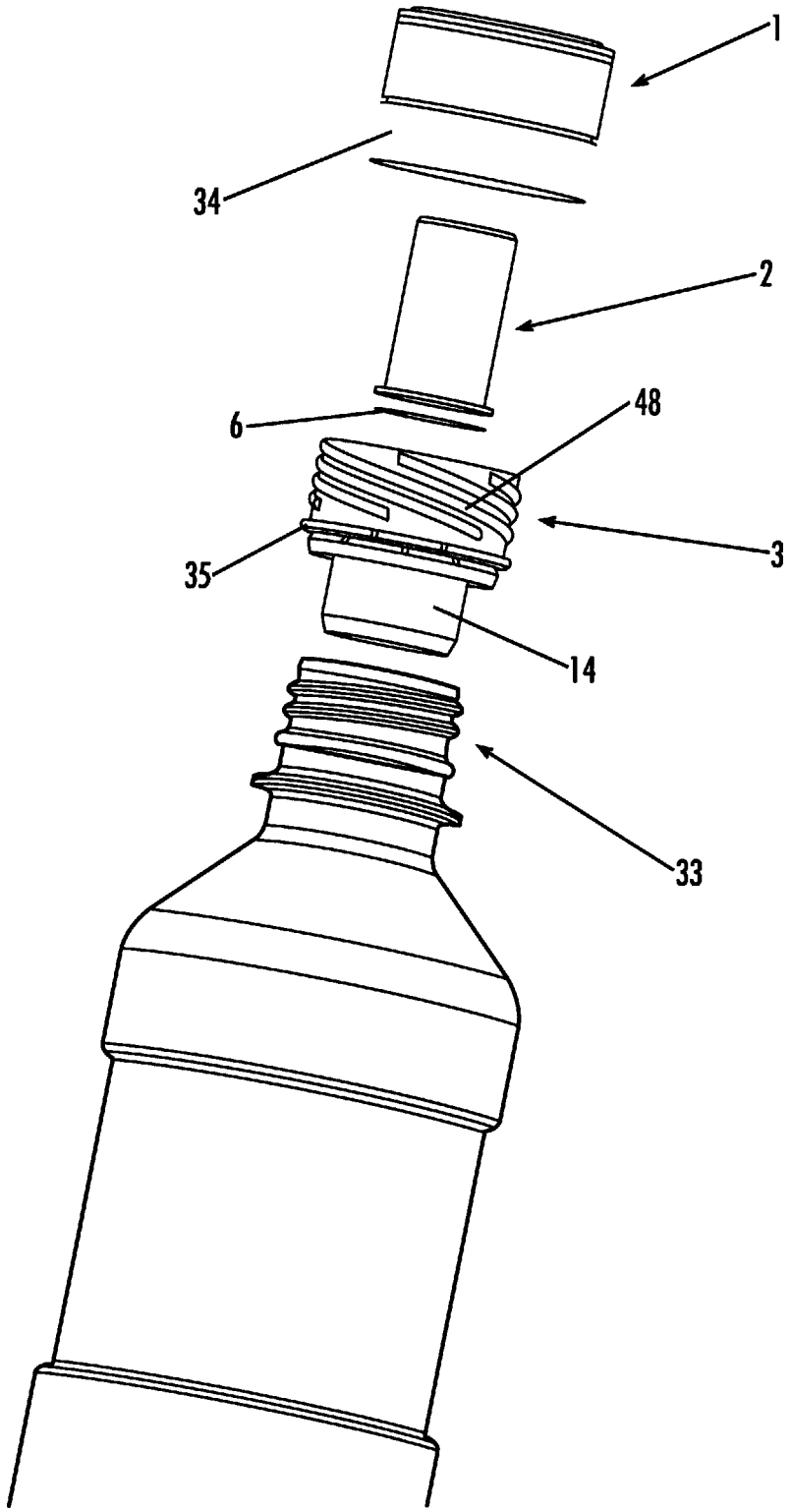
FIG. 6 is an exploded view of the individual parts of a second variant of the spout with a rotating cap, a capsule, a screw-on nozzle and a container bottle, viewed from the side, aligned on their common axis.

A second embodiment variant of this spout is shown in FIG. 6. The container nozzle 33 is designed here as a threaded nozzle with a normal outer thread running clockwise. The screw-on nozzle 3 is rotated and screwed on this threaded nozzle in a clockwise direction. The corresponding threaded nozzle shows a counter-clockwise inner thread. As a special feature, the screw-on nozzle 3 of this second embodiment shows an outer thread 48 running counter-clockwise. The cap 1 with a counter-clockwise thread is screwed on this outer thread from the top in a counter-clockwise movement until a stop is reached that can be removed. This is shown by the fact that the cap 1 shows a guarantee tape 34 at its lower edge formed by the material bridges. This guarantee tape 34 finds a stop on the protruding collar 35 of the nozzle 3. On the top, the screw nozzle 3 is connected on its margin with the upper margin of an opening sleeve 14 running co-axially to it and having a small diameter via a radial bridge. This opening sleeve 14 fits in the inside of the container nozzle 33. At its lower end, it shows a piercing and cutting device having piercing and cutting teeth projecting upward on the inner side.

In the lower side of the cap 1, the capsule 2 at first opens on its downside, filled separately with a substance, and thereafter sealed with a sealing foil 6 that is pushed. inside and held firmly. This capsule 2 can be formed directly on the base of the cap 1. By overturning the cap 1, the capsule 2 is filled and sealed. When the spout is mounted on the container nozzle 33, then this capsule 2 protrudes on the inside of the container nozzle 33, such that the sealing foil 6 of the capsule 2 lies just above the piercing and cutting device. With the removal of the guarantee tape 34, there arises a gap between the lower edge of the cap 1 and the protruding collar 35 at the nozzle 3. The cap 1 can be screwed further downwards by a rotation in the counter-clockwise direction. The capsule 2 rotates with the cap 1 and is thus rotated downwards over the piercing and cutting device so as to pierce and cut the sealing foil 6. Thereafter, the contents of the capsule fall into the container. Finally, the cap l hits with its lower edge on the collar 35 of the nozzle 3 and cannot be screwed down any further. If the capsule 1 is rotated further in the counter-clockwise direction with additional torque, it then takes the nozzle 3 along with it and is loosened from the thread of the container nozzle 33. The complete spout together with the capsule 1 and the nozzle 3 is thus loosened out from the container nozzle 33 and removed, The container is ready for pouring out the contents now mixed with the substance.

Figure 7:
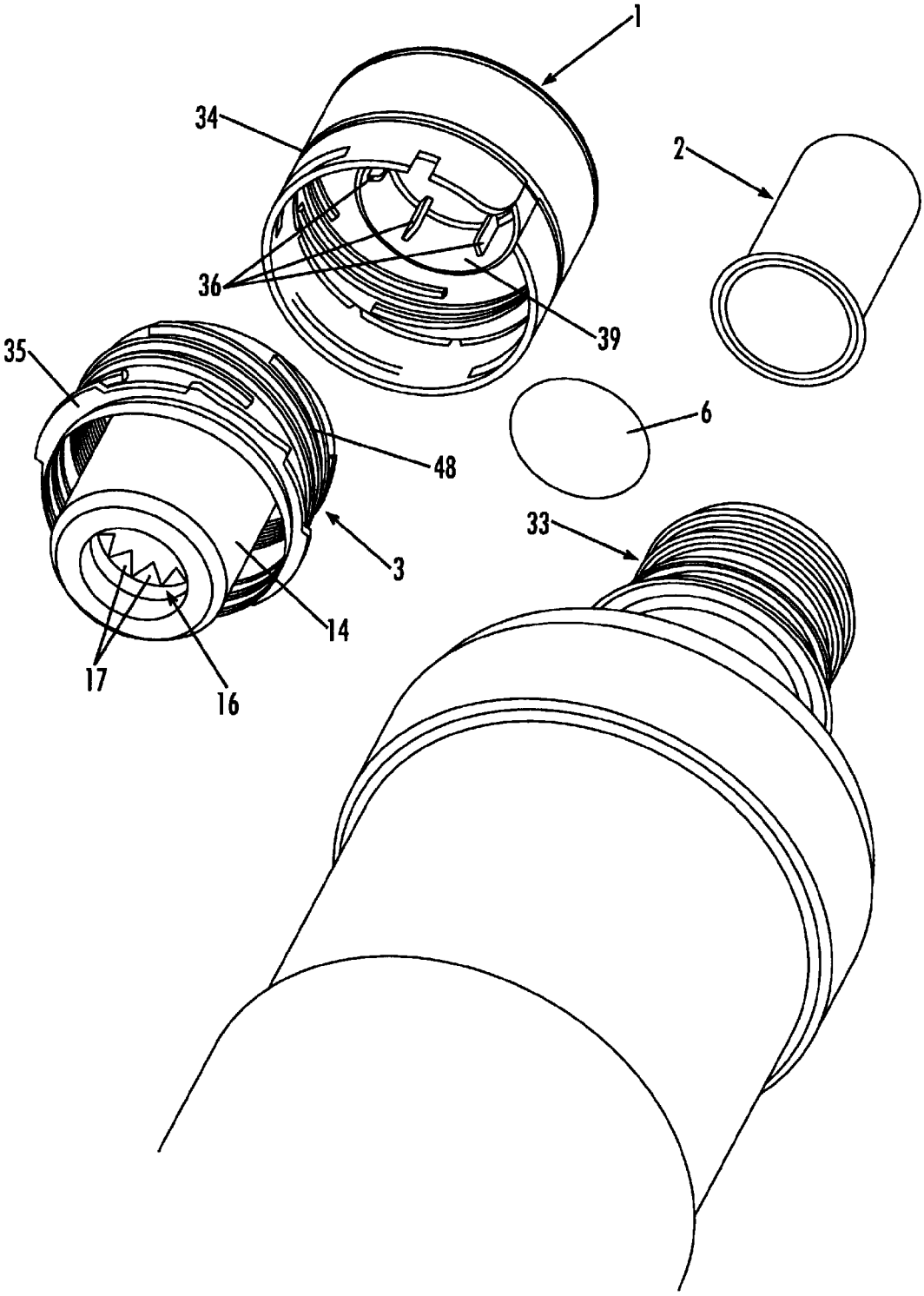
FIG. 7 is an exploded view of the individual parts of the spout as per FIG. 6.

FIG. 7 shows a perspective view of the individual parts of this spout, in a view seen diagonally from below. One can see the radially aligned ribs 36 inside the cap 1 that are formed on a retaining ring 39 and within which the capsule 2 and the substance are retained. At the lower edge of the cap 1, the guarantee tape 34 running around can be seen. On the right near the cap 1 is the capsule 2 with the sealing foil 6. The capsule 2 with its opening is first tilled and aligned upward and thereafter the sealing foil 6 is sealed or welded such that the capsule 2 is sealed. The capsule 2 is then mounted in an overturned position in the cap 1, i.e., with the sealing foil 6 downwards and aligned with its base in the direction of the open side of the cap. Below the cap 1, the nozzle 3 can be seen. This shows an outer thread 48 running counter-clockwise as the inner thread of the cap 1 is run counter-clockwise. If the cap 1 is rotated to the left as seen from above, i.e., in the counter-clockwise direction, then it is screwed on the nozzle 3 until its guarantee tape 7 reaches till the collar 35. The opening sleeve 14 protrudes out of the nozzle 3 from below. The capsule 2 comes to lie in the inside of this sleeve 14 from the top. One can see the piercing and the cutting device 16. To the right near the nozzle 3, the container is shown with the related container nozzle 33.

Figure 8:
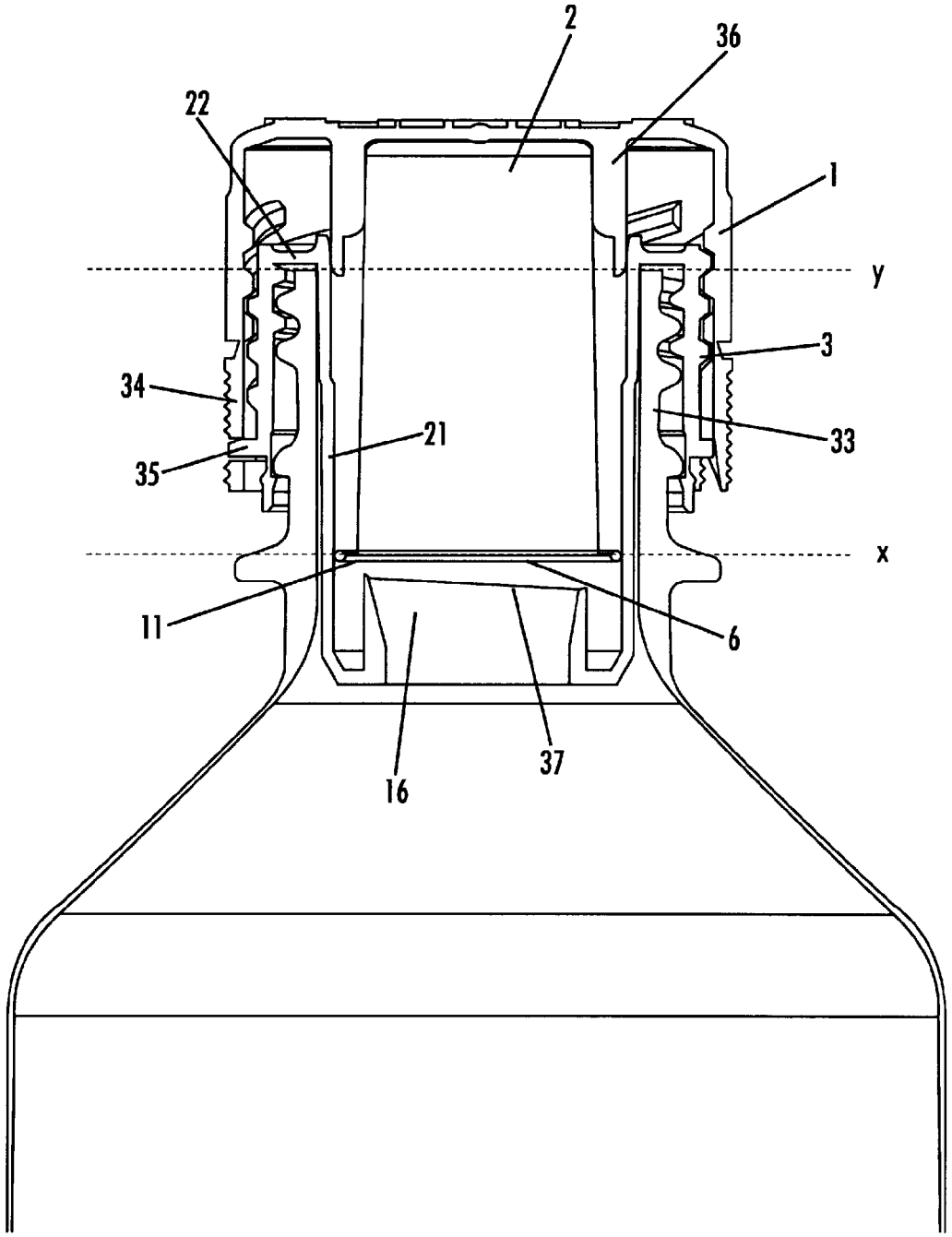
FIG. 8 is a cross-sectional view of this spout mounted on a container with the container nozzle, taken longitudinally along the axis of rotation.

FIG. 8 shows this spout mounted as per FIG. 7, in a cross-section along its axis of rotation. One can see the nozzle 3 that is connected on with the opening sleeve 14 via the radial bridge 22. This opening sleeve 14 is longer than the nozzle 3 and protrudes out from the same. On its lower edge, it carries the piercing and the cutting device 16 connected with it in one piece. This forms at least one upward tooth and one slightly aligned cutting tooth 37. In the given situation, the guarantee tape 34 of the cap 1 lies on the collar 35 at the nozzle 3. The straight dashed line y shows the position of the upper margin of the container nozzle 33 and the straight dashed line x shows the position of the lower edge 11 of the inserted capsule 2 with its sealing foil 6. As one can see, this lower edge 11 lies clearly below the upper margin of the container nozzle 33. In other words, the capsule 2 is integrated in the inside of the container nozzle 33 such that it does not make the spout any bigger than a usual rotating or lid cap. If the guarantee tape 34 is now torn away, then the rotating cap 1 first can be screwed further downwards by a left movement. It takes along with it the capsule 2 downwards, rotates it along with it, and finally presses it in a rotating way with its sealing foil 6 over the piercing and cutting device 16. The sealing foil 6 is thus pierced and cut with the rotating movement of the cutting tooth 37. This opening process goes on until the lower edge of the cap 1 at the collar 35 is present on the nozzle 3.

Figure 9:
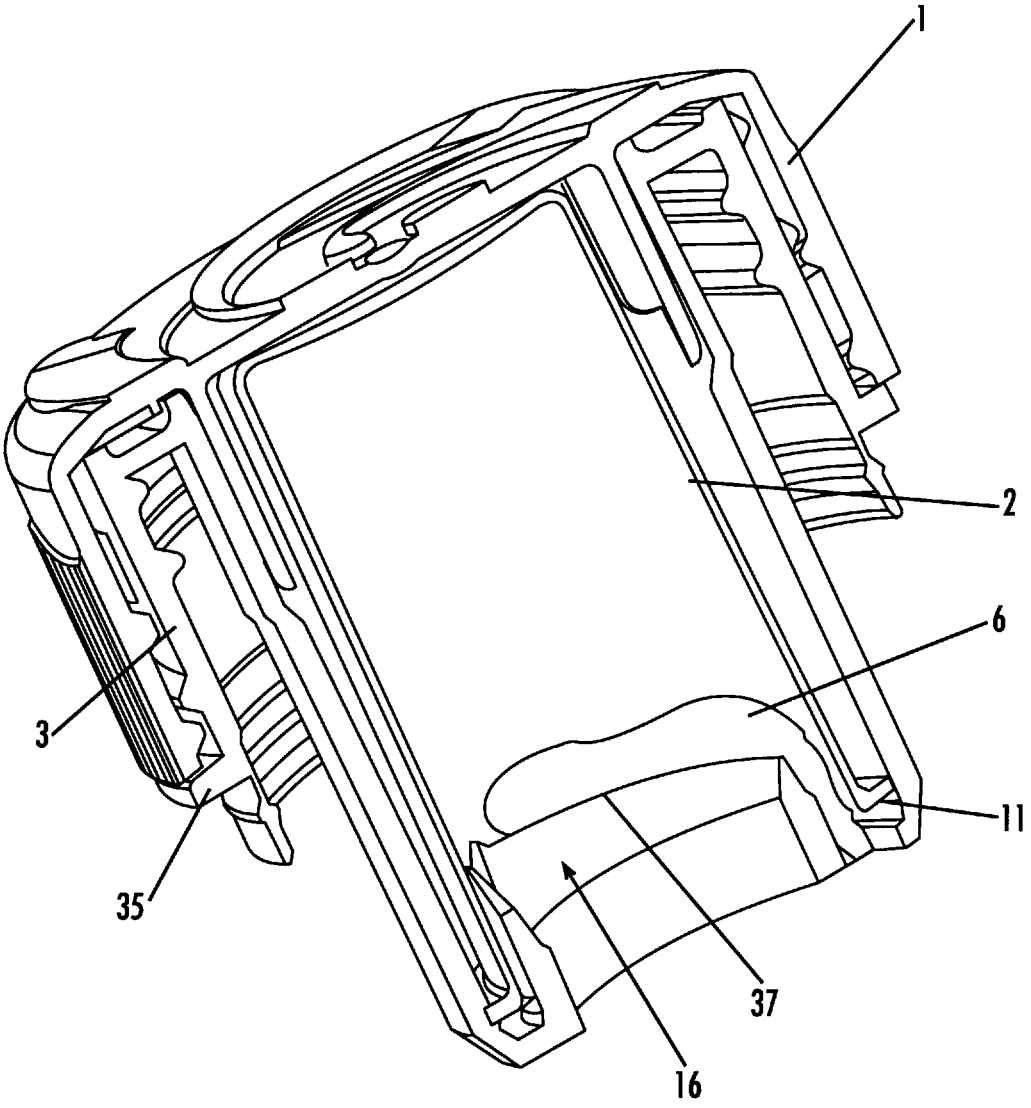
FIG. 9 is a cross-sectional view of the rotating cap and the capsule of the spout, taken longitudinally along the axis of rotation.

This situation with the cut foil piece 6 is shown in FIG. 9. The cap 1 now finds a stop at the collar 35. if the cap is now rotated further left out of this position, then it takes the nozzle 3 forcefully along with it, whereby the same is loosened out from the container nozzle 33. However, the entire spout is now loosened from the container nozzle 33 together with the now empty capsule 2. The spout can he screwed again on to this container nozzle such that the container can be sealed airtight.

Figure 10:
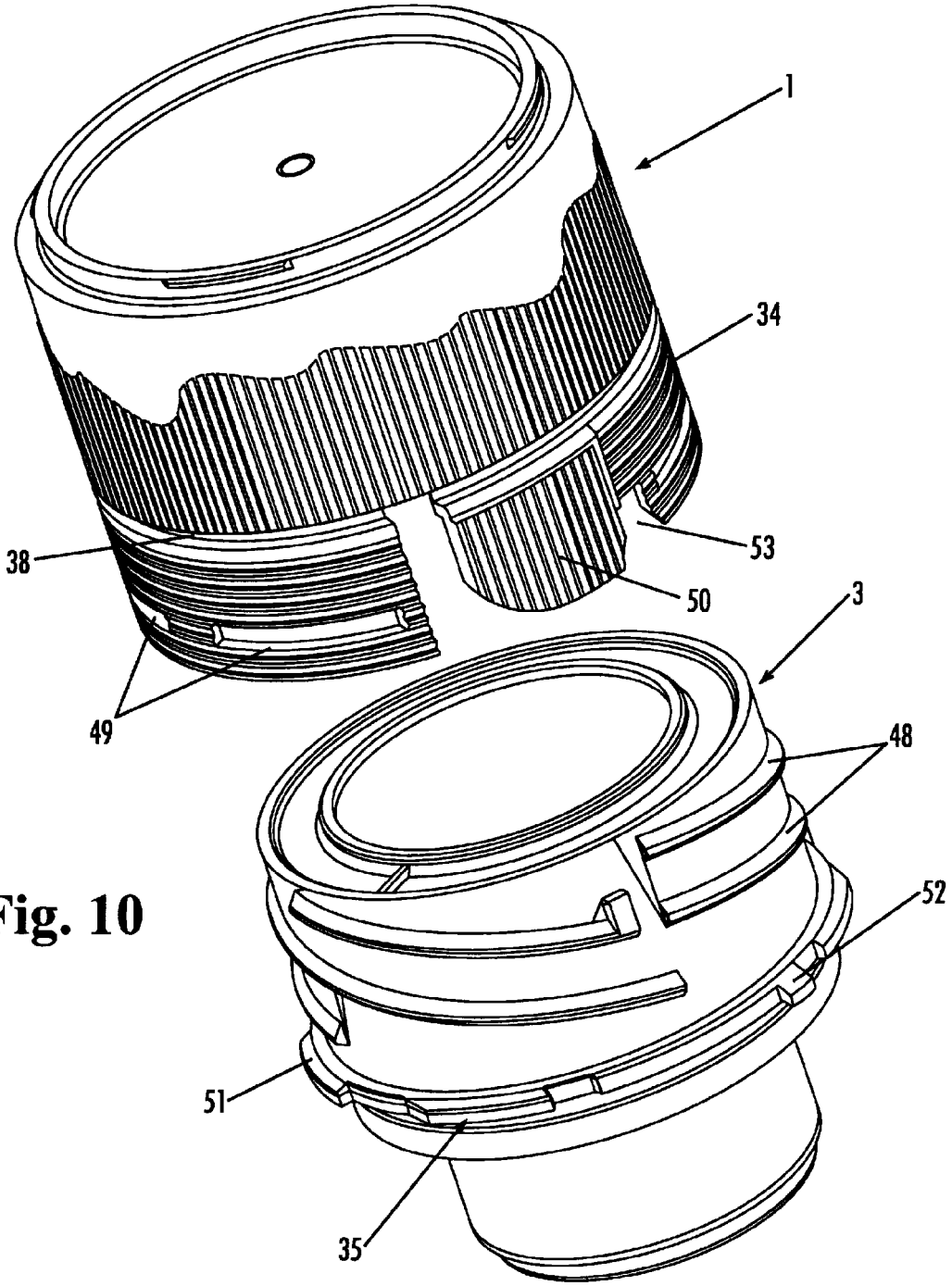
FIG. 10 is a side plan view of the rotating cap with the guarantee tape.

FIG. 10 shows the cap 1 with its guarantee tape 34 at the lower edge of the cap 1. This guarantee tape 34 is fixed in the normal way via a few material bridges or via a continuous thin point 38 as a predetermined breaking point at the lower cap margin. As one can show in the Figure, a number of windows 49 are distributed in length along the periphery. At one end of the guarantee tape 34, this forms a gripping surface 50 which can be folded outside for tearing away the guarantee tape. At the related nozzle 3 with its counter-clockwise rotating outer thread 48, the collar 35 can be seen. This forms radial projections 51, protruding outwards, and beveled at its upper side. The projections 51 fit in the window 49 when the cap 1 is set such that the cap 1 is safeguarded on all sides on the nozzle 3. Through this solution with these windows 49 in the guarantee tape 34, the height of the spout can be reduced vis-à-vis a solution in which the guarantee tape 34 is present with its lower edge on a projection. At the nozzle 3 at the collar 35, a radial cam 52 is formed that fits in the clearance 53 at the lower edge of the guarantee tape 34. The cam 52 serves as an additional safeguard against rotation.

Figure 11:
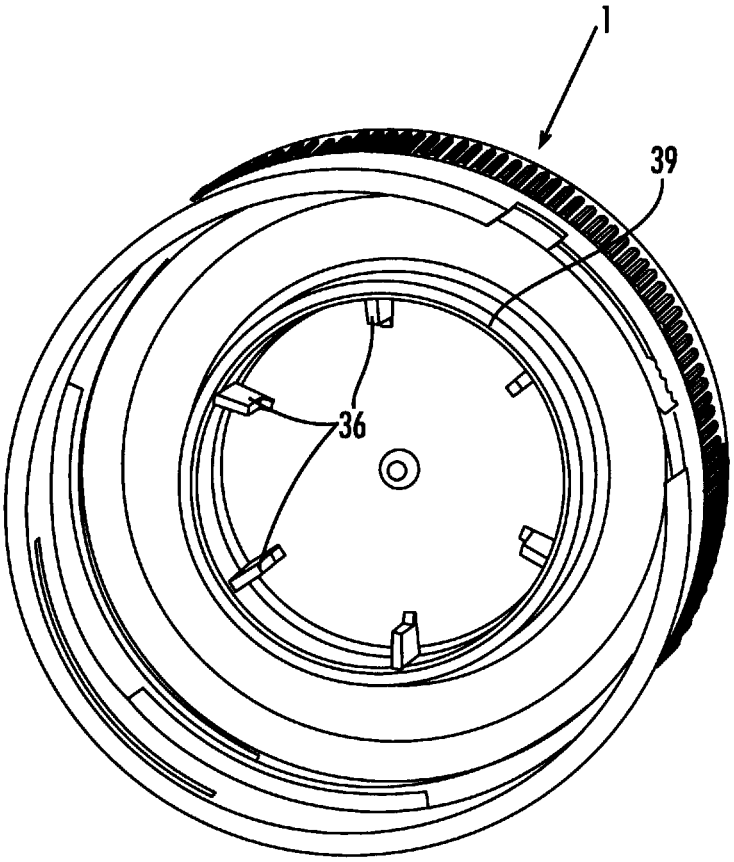
FIG. 11 is a perspective view of the rotating cap with the guarantee tape viewed from below.
Figure 12:
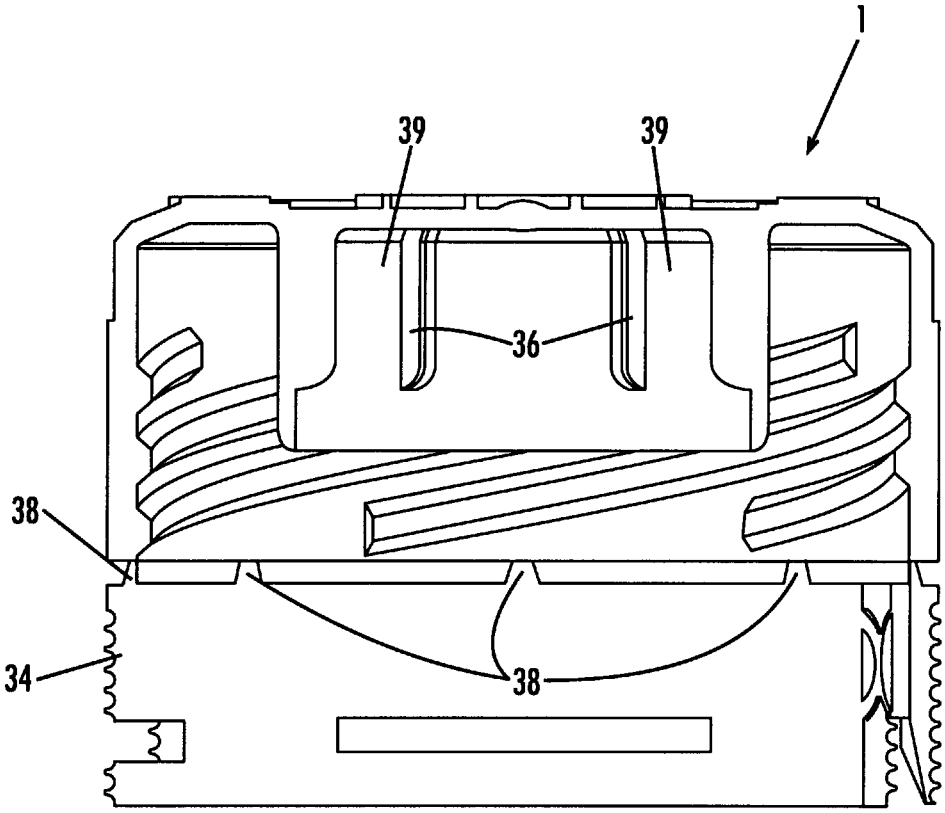
FIG. 12 is a cross-sectional view of the rotating cap with the guarantee tape viewed from the side.

In FIG. 11, the cap 1 is depicted as shown from below. One can see the ribs 36 running radially inside the retaining ring 39 that are formed at the lower side of the cap lid. These ribs 36 serve for fixing the filled and the sealed capsule 2 when these are pressed with their base in the retaining ring 39. FIG. 12 shows the cap 1 seen from the side in a cross-section through its rotating axis. One recognizes the retaining ring 39, which is formed at the inner side of the cap lid, as well as ribs 36 formed radially inwards. The guarantee band 34 can be seen below the cap 1, which is held at the lower cap margin via the material bridges or a continuous thin point 38.

FIG. 13 shows a third embodiment of the spout in the form of a sports or drink closure. The individual parts are dismantled and showed in perspective view. The individual parts are thereby aligned on their common axis. The spout includes six parts. The part acting as the cap 1 is designed as a drink closure. The cap 1 forms a drink nozzle 40 that cooperates with a coaxially arranged stopper 41 of another part that acts as the screw-on nozzle 3. Inside this nozzle, a number of ribs 42 are aligned radially inwards. The capsule 2 with its capsule base, i.e., with its sealing foil 6 downward, is held fixed. The cap 1 shows a collar 43 that runs above in the drink nozzle 40 and forms against it a sleeve 44. This sleeve 44 is positioned over on the nozzle 3 via a guide nozzle 45, which is fixed in a sealing way on the container nozzle 33 as shown in the example. Within this guide nozzle 45 is an opening sleeve 14 with clearances 46 running axially in the outer wall. At the lower end of this opening sleeve 14 is a piercing and cutting device 16 with upwardly aligned piercing and cutting teeth 17. The capsule 2 with its sealing foil 6 is set downward in the opening sleeve against the piercing and cutting device 14 such that when the stopper 41 is pressed down, the capsule 2 with its foil 6 is pressed against the piercing and cutting unit 16.

FIG. 14 shows the receiving sleeve 14. At its lower edge, one can see the piercing and the cutting device 16. Outside on the opening sleeve 14, a number of channels 46 are present such that the liquid can flow out when the drink spout is opened. In FIG. 15, one sees the opening sleeve 14 from the top. Here one can see the individual teeth 17 of the piercing and cutting device 16.

FIG. 16 shows the spout in the mounted state in the initial position. A protective cap 47 also is placed over the cap 1. The stopper 41 protrudes through the opening of the mouthpiece 40 and seals this opening. The capsule 2 inside the opening sleeve 14 is inserted from below and is held on the top by the ribs 42 and is sealed by the sealing foil 6 on the bottom. Below the foil 6 of the capsule 2, the piercing and the cutting device 16 formed at the lower end of the opening sleeve 14. For opening the spout, the protective cap 47 is first removed as shown in FIG. 17. One can now press with a finger on the stopper 41. As a result of which, the capsule 2 is pressed downwards in the opening sleeve 14 and its foil 6 is pressed over the piercing and cutting device. The sealing foil 6 is thereby pierced and cut as is shown in FIG. 18. The capsule 2 is now open and its content can now flow down into the container. The drink nozzle 40 here is already pulled upwards in a locking position by about 4 mm or so. In this position, the stopper 41 closes the opening in the drink nozzle 40. For opening the drink spout, the cap 1 must be pulled further up until the topmost locking position, which is then pulled out by a total of about 6 mm or so. This is shown in FIG. 19. In this position, the spout is ready to be set with the drink nozzle 40 at the mouth. By pushing back the drink nozzle 40, the spout can be sealed again.

FIG. 20 shows this spout with a. somewhat longer drink nozzle 40 in the closed position. The drink nozzle 40 is pushed back so far that the stopper 41 projects in the opening and closes it. FIG. 21 shows this drink nozzle 40 in the open position. FIG. 22 shows a position rotated by a few degrees along the axis such that the liquid flowing out is shown by arrows. The liquid flows along the clearances 46 in the opening sleeve 14, reaches the guide nozzles 45, flows into the stopper 41, and finally flows outside through the opening in the drink nozzle 40.

FIGS. 23-28 show a further embodiment of an ingredient release spout 100 as is described herein. The ingredient release spout 100 includes a cap 110, a capsule 120, and a base such as the screw-on nozzle 130. The cap 110, the capsule 120, and the screw-on nozzle 130 of the ingredient release spout 100 may be similar in design to those elements described above and . ay be used on a spout 140 of a conventional container 150.

Instead of the capsule 2 with the helical collar 7, the ingredient release spout 100 may use the capsule 120 with a capsule nest 160. In this embodiment, the capsule 120 may have a number of straight sections 170 around a ledge 180 on one end thereof. The ledge 180 may be covered with a sealing foil 190. The other end of the capsule 120 may end in a base 200. The capsule 120 may be made in a thermoforming process out of a very thin plastic material. The capsule 120 thus may be somewhat flexible. Other manufacturing techniques may be used herein. The capsule 120 may have an ingredient 210 positioned therein. The ingredient 210 may be any desired type of flowable substances.

The capsule 120 may be positioned within the capsule nest 160. The capsule nest 160 may be a substantially hollow piece with a helical edge 220 on one end and a base 250 at the other. The capsule nest 160 may have a sidewall 230 with a number of straight sections 240. Other designs may be used herein. The capsule nest 160 may be made of substantially rigid material and may be injection molded. Other manufacturing techniques may be used herein. The capsule 120 fits within the capsule nest 160 such that the ledge 180 of the capsule meets at the base 250 of the capsule nest 160.

The cap 110 may be largely similar to the cap 1 described above. The cap 110 may include a circular sidewall 260 with a bulge 270. The sidewall 260 also may have a number of micro-ribs positioned therein. The sidewall 260 may be made out of a soft touch thermoplastic elastomer or similar types of materials. The cap 110 may include a guide sleeve 280 therein. The guide sleeve 280 may have a helical margin 290 formed therein. The helical margin 290 cooperates with the helical edge 220 of the capsule nest 160. The cap 110 also may have a number of cams 300 positioned around the guide sleeve 280. In this embodiment, two sets of cams 300 may be used.

The base or the screw-on nozzle 130 also may be similar to the screw-on nozzle 3 described above. The screw-on nozzle 130 also may have a sidewall 310 with an internal opening sleeve 320 positioned therein. The screw-on nozzle 130 may have a number of barbs 330 and/or a number of cross-plates 335 positioned on one end thereof. The barbs 330 and the cross plates 335 cooperate with the cams 300 so as to lock the cap 110 in place when desired as well as provides an audible sense of the screw-on nozzle 130 rotating. The sidewall 310 also may have a number of internal threads 340 on the other end such that the screw-on nozzle 130 may be positioned on the spout 140 of the container 150. Other types of attachment means may be used herein. The sidewall 310 also may have a pin 345 positioned therein so as to align with the bulge 270 of the cap 110.

The opening sleeve 320 may have a piercing and cutting device 350 positioned therein. As described above, the piercing and cutting device 350 may include a number of teeth 350 positioned therein. Other types of cutters, piercers, or other opening means may be used herein. A rotatable flange 370 may extend across the end of the opening sleeve 320 about the piercing and cutting device 350 so as to prevent any of the sealing foil 190 from entering the container 150.

FIGS. 25 and 26 show the use of the ingredient release spout 100 on the container 150. Specifically, the capsule 120 may be positioned within the capsule nest 160. The capsule nest 160 may be positioned within the opening sleeve 320 of the cap 110 such that the helical edge 220 and the helical margin 290 align. The cap 110, the capsule 120, and the capsule nest 160 then may he positioned on the screw-on nozzle 130. The bulge 270 of the cap 110 aligns with the pin 345 on the screw-on nozzle 130. The ingredient release spout 100 may be positioned on the spout 140 of the container.

As is shown in FIG. 25, the base 250 of the capsule 120 is positioned within the opening sleeve 320 of the screw-on nozzle 130 and is positioned above the teeth 360 of the piercing and cutting device 350 in the raised positioned. As is shown in FIG. 26, rotation of the cap 110 along the helical edge 220 and the helical margin 290 causes the capsule 120 and the capsule nest 160 to rotate downwards such that the sealing foil 190 of the capsule 120 is rotated against the teeth 360 of the piercing and cutting device 350. The sealing foil 190 is thus cut or otherwise opened and the ingredient 210 is released from the capsule 120 and flows into the container 150. Continued rotation of the cap 110 causes the barbs 330 and the cross plates 335 of the screw-on nozzle 130 to abut the cams 300 of the cap 110 such that further rotation of only the cap 110 is not possible. As such, further rotation of the cap 110 removes the entire ingredient release spout 100 from the spout 140 of the container 150.

FIGS. 29-34 show a further embodiment of an ingredient release spout 400 as may be described herein. The ingredient release spout 400 may include a cap 410, a capsule 420, and a screw-on nozzle 430. The ingredient release spout 400 may be used on the spout 140 of the conventional container 150 and the like.

The capsule 420 may be similar to that described above and may include a number of straight sections 440 positioned about a ledge 450 on one end thereof. The ledge 450 may be covered with a sealing foil or other type of sealing layer 460. The capsule 420 may be made in a thermoforming process out of a very thin plastic material and the like. The capsule 420 thus may be somewhat flexible. The capsule 420 also may be injection molded. Other types of manufacturing techniques and other configurations also may be used herein.

The capsule 420 may have an ingredient 470 positioned therein. The ingredient 470 may be any type of flowable substance. The nature of the ingredient 470 may have an impact on the nature of the flexible material used for the capsule 420 and the sealing layer 460. In other words, some ingredients 470 may need a more air tight seal as compared to other types of ingredients. As is shown in FIGS. 30A and 30B, the ingredient 470 may be a liquid 470 or a flowable powder 490. By way of example only, the ingredients 470 may include probiotics as described above. Such ingredients 470 would need a capsule 420 and a sealing layer 460 that would provide a substantially air tight seal with a long term shelf life. Other types of ingredients 470, however, may need less of an aggressive barrier.

The cap 410 may be made out of an injection molded thermoplastic and the like. Other types of materials and other types of manufacturing techniques may be used herein. The cap 410 may include a circular cap sidewall 500. The circular cap sidewall 500 may have a number of sidewall ribs 510 positioned thereon so as to aid in gripping and turning the cap 410. The cap 410 may include a tamper evident band 520 at a bottom 530 of the circular cap sidewall 500. The tamper evident band 520 may be a frangible band and the like that breaks once the circular cap sidewall 500 is turned. The tamper evident band 520 may include a number of cap band ribs 540 on an interior thereof. Other components and other configurations may be used herein.

The interior of the circular cap sidewall 500 may include a pair of circular cap threads 550. The circular cap threads 550 may form an endless cap grove 560 therebetween. The interior of the circular cap sidewall 500 also may have a pair or more of cap cross-plates 570. The circular cap threads 550, the endless cap grove 560, and the cap cross-plates 570 may cooperate with similar structures positioned on the nozzle 430 as will be described in more detail below to control rotation of the cap 410. Other components and other configurations may be used herein.

The cap 410 may include a capsule insert 580. The capsule insert 580 extends from a top surface 590 and downward past the bottom 530 thereof. The capsule insert 580 may be substantially hollow and circular in shape. The capsule insert 580 may be sized for the capsule 420 to be positioned therein. Other components and other configurations may be used herein.

The capsule insert 580 may include a circular band 600 extending along the circumference thereof. The circular band 600 is a raised band that cooperates with the spout 140 of the container 150 as may be described below. The capsule insert 580 also may include a number of capsule insert threads 610 positioned thereon. The threads 610 may be continuous or in the form of a number of segments. The threads 610 may cooperate with the nozzle 430 as will be described in more detail below. Other components and other configurations may be used herein.

The cap 410 also may include a diaphragm 620 positioned along the top surface 590 thereof. The diaphragm 620 may include one or more indented surfaces 630 followed by one or more raised surfaces 640 so as to form a number of concentric circles 650. The diaphragm 620 thus has the indented surfaces 630 and the raised surfaces 640 to allow the top surface 590 and the capsule insert 580 to be pulled downward by unfolding the indented surfaces 630 and the raised surfaces 640. Any type of elastically extending surfaces may be used herein as the diaphragm 630. Other components and other configurations may be used herein.

The base or the screw-on nozzle 430 also may have a circular nozzle sidewall 660 with an internal opening sleeve 670 positioned therein. The nozzle 430 also may have a number of nozzle ribs 680 positioned about the circular nozzle sidewall 660. The nozzle ribs 680 may cooperate with the band ribs 540 of the tamper evident band 520 such that the tamper evident band 520 locks in place and separates from the circular sidewall 500 when the cap 410 begins to rotate. Other components and other configurations may be used herein.

The nozzle 430 also may have a number of nozzle cross plates 690 positioned on the circular nozzle sidewall 600. The nozzle cross-plates 690 cooperate with the cap cross-plates 570 so as to stop the rotation of the cap 410 with respect to the nozzle 430 as will be described in more detail below. The nozzle 430 also may include a pair of circular nozzle threads 700. The circular nozzle threads 700 may form an endless nozzle groove 710. The circular nozzle threads 700 and the endless nozzle groove 710 cooperate with the circular cap threads 550 and the endless cap groove 560 so as to permit the cap 410 to rotate horizontally about the nozzle 430 until the cap cross-plates 570 and the nozzle cross-plates 690 come into contact. Other component and other configurations may be used herein.

The nozzle 430 also may have a number of interior threads 720 positioned within the circular nozzle sidewall 660. The internal threads 720 may cooperate with the spout 140 of the container 150. Other types of attachment means may be used herein to mount the nozzle 430 securely on the spout 140 of the container 150.

The internal opening sleeve 670 of the nozzle 430 may have a number of sleeve threads 730 positioned therein. The sleeve threads 730 may be continuous or in the form of a number of segments. The sleeve threads 730 may cooperate with the capsule threads 610 of the capsule insert 580 of the cap 410. The sleeve threads 730 act to pull the capsule insert 580 downward when the cap 410 is rotated given the use of the diaphragm 620. Other components and other configurations may be used herein.

The internal opening sleeve 670 of the nozzle 430 also may include a cutting device 740. The cutting device 740 shown herein may be in the form of a cylinder 750 connected to the internal opening sleeve 670 by a number of support ribs 760. Other types of cutters, piercers, and other opening means also may be used herein in any configuration and with any type of support structures. The use of the cylinder 750 detaches at least a part of the sealing layer 460 from the capsule insert 580 while retaining the entire sealing layer 460 within the internal opening sleeve 670. Other components and other configurations may be used herein.

In use, one or more ingredients 470 may be positioned within the capsule 420 and sealed with the sealing layer 460. The capsule 420 may be positioned within the capsule insert 580. The cap 410 with the capsule 420 therein then may be placed on the nozzle 430. The circular nozzle thread 700 and the endless nozzle groove 710 may align with the circular cap threads 550 and the endless cap groove 560. The ingredient release spout 400 then may be positioned about the spout 140 of the container 150 and secured thereto.

To open the ingredient release spout 400, the cap 410 may be horizontally rotated about the nozzle 430. Rotating the cap 410 first causes the tamper evident band 520 to separate from the circular cap sidewall 500 of the cap 410. Further horizontal rotation of the cap 410 causes the capsule insert 580 to move downward via the coordination of the capsule threads 610 of the capsule insert 580 and the sleeve threads 730 of the nozzle 430 via the diaphragm 620. Further horizontal rotation of the cap 410 causes the cutting device 740 to cut the sealing layer 460 such that the ingredients 470 flow into the container 150, Even though the foil sealing layer 460 has been breached, the circular band 600 maintains the container 150 under seal due to its position on the capsule insert 580 with respect to the spout 140 of the container 150. This seal allows the container 150, for example, to be shaken once the cap 410 has been turned a sufficient degree so as to allow the ingredients 470 to fall therein but without removing the cap 410.

The cap 410 may rotate about the nozzle 430 until the cap cross-plates 570 encounter the nozzle cross-plates 690. Further turning of the cap 410 then would cause the nozzle 430 to move upward via the internal threads 720 such that the ingredient release spout 400 may be removed from the container 150. Other configurations and other components may be used herein.

FIG. 35 shows a further alternative embodiment of an ingredient release spout 800 as may be described herein. The ingredient release spout 800 may include the cap 410 positioned on the screw on nozzle 430 largely as described above. Instead of using the capsule 420, however, the sealing layer 460 may be positioned directly across the capsule insert 580. As such, the ingredient 470 may be positioned within the capsule insert 580 and the sealing layer 460 applied. The cap 410 then may be positioned along the nozzle 430 and may operate largely as described above. Other components and other configurations also may be used herein.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. An ingredient release spout with an ingredient therein for use on a container, comprising:
   a cap;
   the cap comprising an diaphragm with a capsule insert extending therefrom and with the ingredient therein;
   the diaphragm comprises a plurality of indented surfaces and a plurality of raised surfaces forming concentric circles; and
   a screw on nozzle;
   the screw on nozzle comprising a plurality of internal threads that cooperate with a spout of the container; and
   the screw on nozzle comprising a cutting device therein such that rotating the cap internally pulls the diaphragm and the capsule insert towards the cutting device.

2. The ingredient release spout of claim 1, wherein capsule insert comprises a sealing layer thereon.

3. The ingredient release spout of claim 1, further comprising a capsule positioned within the capsule insert and with the ingredient therein.

4. The ingredient release spout of claim 3, wherein the capsule comprises a sealing layer thereon.

5. The ingredient release spout of claim 1, wherein the cap comprises a tamper evident band.

6. The ingredient release spout of claim 1, wherein the cap comprises a pair of circular cap threads and wherein the screw on nozzle comprises a pair of circular nozzle threads that cooperate therewith for horizontal rotation of the cap.

7. The ingredient release spout of claim 1, wherein the cap comprises one or more cap cross-plates and the screw on nozzle comprises one or more nozzle cross-plates that cooperate therewith to stop horizontal rotation of the cap.

8. The ingredient release spout of claim 1, wherein the capsule insert comprises a circular band therein sized according to a spout of the container.

9. The ingredient release spout of claim 1, wherein the capsule insert comprises one or more capsule insert threads and wherein the screw on nozzle comprises one or more sleeve threads that cooperate therewith to pull the capsule insert downward.

10. The ingredient release spout of claim 1, wherein the screw on nozzle comprises an internal opening sleeve with the cutting device therein.

11. The ingredient release spout of claim 1, wherein the cutting device comprises a cylinder and a number of supports.

12. An ingredient release spout for use on a container, comprising:
   a cap;
   the cap comprising an diaphragm with a capsule insert extending therefrom;
   the diaphragm comprises a plurality of indented surfaces and a plurality of raised surfaces forming concentric circles;
   an ingredient positioned within the capsule insert; and
   a screw on nozzle;
   the screw on nozzle comprising a plurality of internal threads that cooperate with the spout of the container; and
   the screw on nozzle comprising a cutting device therein such that rotating the cap internally pulls the diaphragm and the capsule insert towards the cutting device so as to release the ingredient into the container.

13. The ingredient release spout of claim 12, wherein the ingredient comprises a probiotic ingredient.

14. The ingredient release spout of claim 12, wherein capsule insert comprises a sealing layer thereon.

15. The ingredient release spout of claim 12, further comprising a capsule positioned within the capsule insert and with the ingredient therein.

16. The ingredient release spout of claim 15, wherein the capsule comprises a sealing layer thereon.

* * * * *